US011434698B2

(12) United States Patent
Deen et al.

(10) Patent No.: US 11,434,698 B2
(45) Date of Patent: Sep. 6, 2022

(54) DRILL BIT

(71) Applicant: Ulterra Drilling Technologies, L.P., Fort Worth, TX (US)

(72) Inventors: Carl Aron Deen, Fort Worth, TX (US); Christopher M. Casad, Benbrook, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 17/014,544

(22) Filed: Sep. 8, 2020

(65) Prior Publication Data

US 2021/0071479 A1 Mar. 11, 2021

Related U.S. Application Data

(60) Provisional application No. 62/897,682, filed on Sep. 9, 2019.

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/43; E21B 10/55; E21B 10/567; E21B 10/42
See application file for complete search history.

(56) References Cited

U.S. PATENT DOCUMENTS

| | | | | |
|---|---|---|---|---|
| 5,549,171 | A | 8/1996 | Mensa-Wilmot et al. | |
| 6,164,394 | A * | 12/2000 | Mensa-Wilmot | E21B 10/43 175/431 |
| 9,556,683 | B2 | 1/2017 | Simmons et al. | |
| 2010/0089664 | A1* | 4/2010 | Welch | E21B 10/006 175/431 |
| 2010/0175930 | A1* | 7/2010 | Schwefe | E21B 10/43 175/431 |
| 2010/0320001 | A1* | 12/2010 | Kulkarni | E21B 10/14 175/336 |
| 2013/0008724 | A1 | 1/2013 | Endres et al. | |

OTHER PUBLICATIONS

International Application No. PCT/US2020/049728, International Search Report and Written Opinion, dated Nov. 9, 2020, 11 pages.
International Application No. PCT/US2020/049728, International Preliminary Report on Patentability, dated Mar. 17, 2022, 8 pages.

* cited by examiner

*Primary Examiner* — Caroline N Butcher
(74) *Attorney, Agent, or Firm* — Kilpatrick Townsend & Stockton LLP

(57) ABSTRACT

A drill bit including a body having a face and a bit axis. The face includes a cone region disposed about the bit axis, a nose region disposed radially outward from the cone region, and a shoulder region disposed radially outward from the nose region. The drill bit further includes a first plurality of cutters defining a first cutting profile, and a second plurality of cutters defining a second cutting profile different from the first cutting profile. The second plurality of cutters are not back-up cutters to the first plurality of cutters.

29 Claims, 10 Drawing Sheets

DRILL BIT

PRIORITY

This application claims priority to U.S. Provisional Application No. 62/897,682, filed on Sep. 9, 2019, which is incorporated herein by reference.

FIELD OF THE INVENTION

The present disclosure generally relates to drill bits with improved stability, durability, and drilling speed. In particular, the disclosure relates to a drill bit comprising multiple cutting profiles formed by primary cutters.

BACKGROUND OF THE INVENTION

Drill bits, such as rotary drag bits, reamers, and similar downhole tools for boring or forming holes in subterranean rock formations are well-known. When drilling oil and natural gas wells, rotary drag bits drag discrete cutting structures, referred to as "cutters," mounted in fixed locations on the body of the tool against the formation. As the cutters are dragged against the formation by rotation of the tool body, the cutters fracture the formation through a shearing action. This shearing action forms small chips that are evacuated hydraulically by drilling fluid pumped through nozzles in the tool body.

One such fixed cutter, earth boring tool, generally referred to in the oil and gas exploration industry as a polycrystalline diamond compact or PDC bit, employs fixed cutters. Each cutter has a highly wear resistant cutting or wear surface comprised of PDC or similar highly wear resistant material. PDC cutters are typically made by forming a layer of polycrystalline diamond (PCD), sometimes called a crown or diamond table, on an erosion resistant substrate. The PDC wear surface is comprised of sintered polycrystalline diamond (either natural or synthetic) exhibiting diamond-to-diamond bonding. Polycrystalline cubic boron nitride, wurtzite boron nitride, aggregated diamond nanotubes (ADN) or other hard, crystalline materials are known substitutes and may be useful in some drilling applications. A compact is made by mixing a diamond grit material in powder form with one or more powdered metal catalysts and other materials, forming the mixture into a compact, and then sintering it, typically with a tungsten carbide substrate using high heat and pressure or microwave heating. Sintered compacts of polycrystalline cubic boron nitride, wurtzite boron nitride, ADN and similar materials are, for the purposes of description contained below, equivalents to polycrystalline diamond compacts and, therefore, a reference to "PDC" in the detailed description should be construed, unless otherwise explicitly indicated or context does not allow, as a reference to a sintered compacts of polycrystalline diamond, cubic boron nitride, wurtzite boron nitride and other highly wear resistant materials. References to "PDC" are also intended to encompass sintered compacts of these materials with other materials or structure elements that might be used to improve its properties and cutting characteristics. Furthermore, PDC encompasses thermally stable varieties in which a metal catalyst has been partially or entirely removed after sintering.

Substrates for supporting a PDC wear surface or layer are typically made, at least in part, from cemented metal carbide, with tungsten carbide being the most common. Cemented metal carbide substrates are formed by sintering powdered metal carbide with a metal alloy binder. The composite of the PDC and the substrate can be fabricated in a number of different ways. It may also, for example, include transitional layers in which the metal carbide and diamond are mixed with other elements for improving bonding and reducing stress between the PCD and substrate.

Each PDC cutter is fabricated as a discrete piece, separate from the drill bit. Because of the processes used for fabricating them, the PCD layer and substrate typically have a cylindrical shape, with a relatively thin disk of PCD bonded to a taller or longer cylinder of substrate material. The resulting composite can be machined or milled to form a desired shape. However, the PCD layer and substrate are typically used in the cylindrical form in which they are made.

Fixed cutters are mounted on an exterior of the body of an earth boring tool in a predetermined pattern or layout. Furthermore, depending on the particular application, the cutters are typically arranged along each of several blades, which are comprised of raised ridges formed on the body of the earth boring tool. Each blade typically includes a flat surface, oriented parallel to the formation being cut. The cutters are usually disposed in holes or openings along these flat surfaces. In a PDC bit, for example, blades are generally arranged in a radial fashion around the central bit axis (axis of rotation) of the bit. They typically, but do not always, curve in a direction opposite to that of the direction of rotation of the bit.

As an earth boring tool having fixed cutters is rotated, the cutters collectively present one or more predetermined cutting profiles to the earth formation, shearing the formation. A cutting profile is defined by the position and orientation of each of the cutters associated with it as they rotate through a plane extending from the earth boring tool's axis of rotation outwardly (e.g., bit axis). A cutter's position along the cutting profile is primarily a function of its lateral displacement from the bit axis (axis of rotation) and not the particular blade on which it lies. Cutters adjacent to each other in a cutting profile are typically not next to each other on the same blade. Conversely, cutters that are adjacent to one another in a cutting profile are typically on different blades.

In addition to position or location on the bit, each cutter has a three-dimensional orientation. Generally, this orientation will be defined with respect to one of two coordinate frames: a coordinate frame of the bit, defined in reference to its axis of rotation; or a coordinate frame generally based on the cutter itself. The orientation of a cutter is usually specified in terms of a back inclination or rotation of the cutter and a side inclination or rotation of the cutter. Back inclination or "back rake" is specified in terms of an axial rake or back rake angle, depending on frame of reference used. Side inclination or "side rake" is typically specified in terms lateral rake or side rake angle, depending on the frame of reference used. Such drill bits are described, for example, in U.S. Pat. No. 9,556,683, the entirety of which is incorporated herein by reference.

U.S. Pat. No. 5,549,171 describes a fixed cutter drill bit that includes sets of cutter elements mounted on the bit face. Each set includes at least two cutters mounted on different blades at generally the same radial position with respect to the bit axis but having differing degrees of back rake. The cutter elements of a set may be mounted having their cutting faces out-of-profile, such that certain elements in the set are exposed to the formation material to a greater extent than other cutter elements in the same set. The cutter elements in a set may have cutting faces and profiles that are identical, or they may vary in size or shape or both. The bit exhibits increased stability and provides substantial improvement in rates of penetration (ROP) without requiring excessive weight on bit (WOB). FIGS. 7-11 of the '171 patent illustrate cutter elements having varying exposure heights.

The need exists for subterranean drill bits having cutting profiles configured for improved bit stability and durability and/or improved ROP.

SUMMARY OF THE INVENTION

Embodiments of the present technology may include drill bits. In some embodiments, an exemplary drill bit may include a body having a face and a bit axis. The face may include a cone region disposed about the bit axis, a nose region disposed radially outward from the cone region, and a shoulder region disposed radially outward from the nose region. The drill bit may further include a first plurality of cutters and a second plurality of cutters. The first plurality of cutters may define a first cutting profile. The second plurality of cutters may define a second cutting profile different from the first cutting profile. At least a portion of the first cutting profile may coincide with or may intersect at least a portion of the second cutting profile. The first cutting profile and the second cutting profile may define different slopes in the cone region.

In some embodiments, the second cutting profile may define a greater slope in the cone region than the first cutting profile. In some embodiments, the first cutting profile and the second cutting profile may coincide in at least one of the nose region or the shoulder region. In some embodiments, the second cutting profile may be recessed relatively to the first cutting profile in at least one of the cone region, the nose region, or the shoulder region. In some embodiments, the second cutting profile may protrude from the first cutting profile in at least one of the nose region or the shoulder region. In some embodiments, the first cutting profile and the second cutting profile may define different curvatures in at least one of the nose region or the shoulder region. In some embodiments, the first cutting profile may intersect the second cutting profile at a single location. In some embodiments, the first cutting profile may intersect the second cutting profile at two discreet locations. In some embodiments, the first cutting profile and the second cutting profile may coincide in at least one of the nose region, the shoulder region, or a gauge region.

In some embodiments, a majority of the first plurality of cutters may be primary cutters. In some embodiments, a majority of the second plurality of cutters may be primary cutters. In some embodiments, the first plurality of cutters and the second plurality of cutters have equal number of cutters. In some embodiments, the drill bit may further include a third plurality of cutters defining a third cutting profile. The third cutting profile may be different from at least one of the first cutting profile or the second cutting profile. The first plurality of cutters, the second plurality of cutters, and the third plurality of cutters may have equal number of cutters.

In some embodiments, the drill bit may further include a first blade disposed on the face. The first plurality of cutters may be disposed on the first blade. In some embodiments, the second plurality of cutters may be disposed on the first blade. In some embodiments, the drill bit may further include a second blade. The second plurality of cutters may be disposed on the second blade. In some embodiments, at least one of the first plurality of cutters may be disposed at a common radial distance as at least one of the second plurality of cutters.

In some embodiments, the drill bit may further include a plurality of blades. The first plurality of cutters may be disposed on a first blade of the plurality of blades. The second plurality of cutters may be disposed on a second blade of the plurality of blades. Cutters on each blade of the plurality of blades may define a cutting profile different from any cutting profile defined by cutters on any other blade of the plurality of blades.

In some embodiments, a majority of the first plurality of cutters and a majority of the second plurality of cutters may be arranged in an alternating manner. In some embodiments, a majority of the first plurality of cutters and a majority of the second plurality of cutters may be disposed at different radial distances from the bit axis. In some embodiments, the first cutting profile may define a smooth cutting profile. In some embodiments, the first plurality of cutters may have back rake angles within a first range, and the second plurality of cutters may have back rake angles within a second range different from the first range. In some embodiments, the first plurality of cutters may have side rake angles within a first range, and the second plurality of cutters may have side rake angles within a second range different from the first range.

In some embodiments, an exemplary drill bit may include a bit body having a bit face and a bit axis. The drill bit may further include a first plurality of cutters and a second plurality of cutters. The first plurality of cutters may define a first cutting profile. The second plurality of cutters may define a second cutting profile different from the first cutting profile. The first cutting profile and the second cutting profile may define different slopes in a cone region of the bit face. In some embodiments, the second plurality of cutters may not be back-up cutters to the first plurality of cutters. In some embodiments, a majority of the first plurality of cutters and a majority of the second plurality of cutters may be disposed at different radial distances from the bit axis. In some embodiments, the first plurality of cutters and the second plurality of cutters may not be gauge cutters.

Embodiments of the present technology may include drilling methods. In some embodiments, an exemplary method of drilling a subterranean formation may include engaging a subterranean formation with at least one cutter of a drill bit. In some embodiments, the drill bit may include a bit body having a bit face and a bit axis. The drill bit may further include a first plurality of cutters and a second plurality of cutters. The first plurality of cutters may define a first cutting profile. The second plurality of cutters may define a second cutting profile different from the first cutting profile. At least a portion of the first cutting profile may coincide with or may intersect at least a portion of the second cutting profile. The first cutting profile and the second cutting profile may define different slopes in a cone region of the bit face.

Embodiments of the present technology may include methods of configuring drill bits. An exemplary method of configuring a drill bit may include configuring a bit body having a bit face and a bit axis. The method may further include configuring a first plurality of cutters defining a first cutting profile. The method may also include configuring a second plurality of cutters defining a second cutting profile different from the first cutting profile. At least a portion of the first cutting profile may coincide with or may intersect at least a portion of the second cutting profile. The second plurality of cutters may not be back-up cutters to the first plurality of cutters.

Embodiments of the present technology may include methods of making a drill bit. An exemplary method of making a drill bit may include providing a bit body having a bit face and a bit axis. The method may further include providing a first plurality of cutters defining a first cutting profile. The method may also include proving a second plurality of cutters defining a second cutting profile different from the first cutting profile. The first cutting profile and the second cutting profile may define different slopes in a cone region of the bit face. The second plurality of cutters may not be back-up cutters to the first plurality of cutters.

BRIEF DESCRIPTION OF THE DRAWINGS

The present invention will be better understood in view of the appended non-limiting figures, in which.

DETAILED DESCRIPTION OF THE INVENTION

I. Introduction

Figure 1:
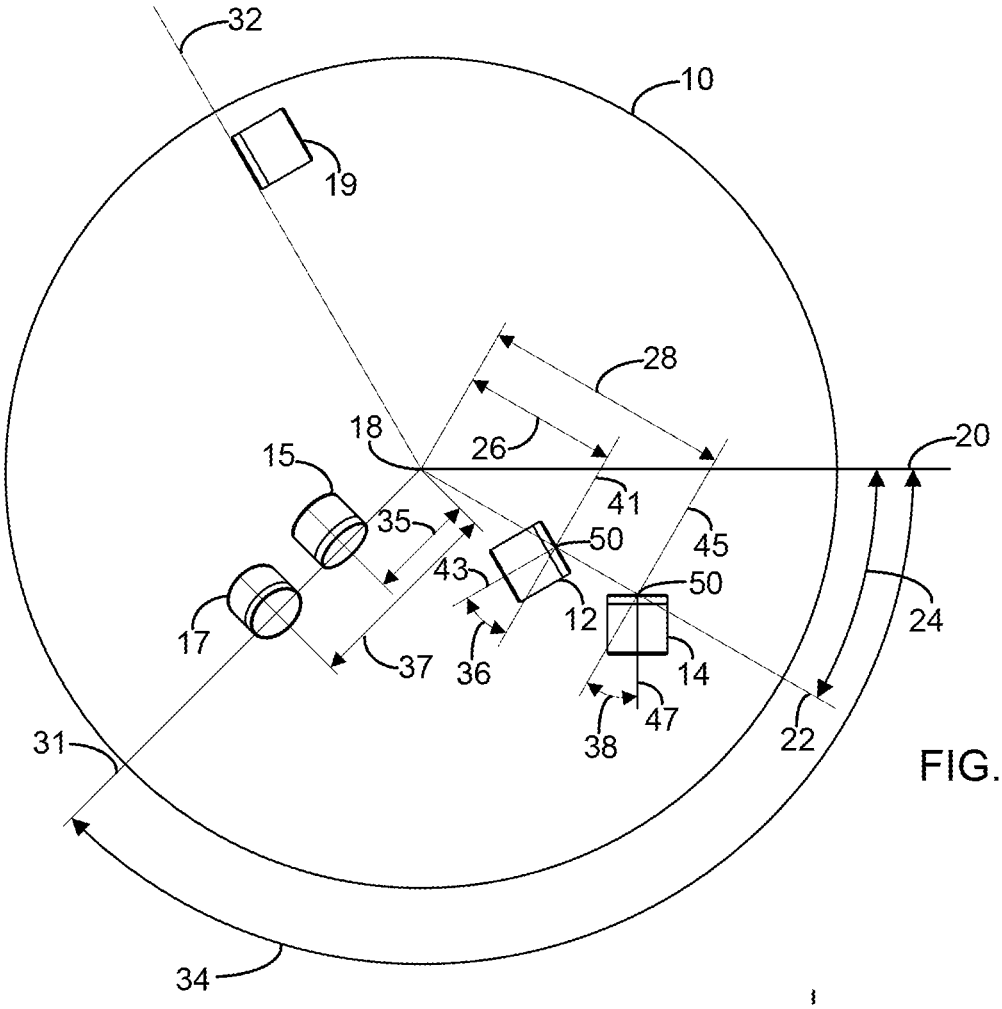
FIG. 1 shows a schematic illustration of a face view of a drill bit, in accordance with some embodiments of the present invention.

The present disclosure is directed to primary cutting profile configurations for primary cutters on a drill bit. The drill bit may include a first plurality of cutters defining a first cutting profile, and a second plurality of cutters defining a second cutting profile different from the first cutting profile. The second plurality of cutters preferably are not back-up cutters to the first plurality of cutters. The first and second cutting profiles are different from one another such that, in some embodiments, at least a portion of the first cutting profile may coincide with or intersect at least a portion of the second cutting profile. In some embodiments, the first cutting profile and the second cutting profile may define different slopes in a cone region of the bit face. In some embodiments, the first cutting profile and the second cutting profile may further define different profile curvatures in at least one of a nose region or a shoulder region of the bit face Advantageously, by forming multiple cutting profiles at least in the cone region, improved bit stability may be achieved without negatively affecting the ROP. Further, by forming multiple cutting profiles in one or more of the cone, nose, and/or shoulder regions of a drill bit, a more aggressive and yet more durable bit can be obtained. When the drilling operation first begins, only primary cutters on one of the multiple cutting profiles, e.g., a protruding cutting profile, may engage the formation. Thus, each cutter may bear more weight load and cut more aggressively, yielding a higher ROP. The cutters defining the other cutting profile(s) may provide bit stability and/or control by inhibiting or preventing over-engagement by the cutters on the protruding cutting profile. As the drilling operation continues, wear or damage in the cutters on the protruding cutting profile may occur. Cutters on the remaining cutting profile(s) may engage the formation to prolong the bit operational life while maintaining the ROP.

II. Cutter Arrangement

Cutter geometry varies widely in the industry. In some aspects, the cutter, e.g., PDC cutter, has a generally cylindrically shaped "substrate," with a flat or generally flat top with a layer of polycrystalline diamond (PCD) disposed thereon. The PCD layer is sometimes referred to as a crown or diamond "table" that functions as the cutter's primary working surface. Although in some aspects, the cutters used according to the present disclosure are cylindrical in shape, in other embodiments, the cutters may have an oblong or oval lateral cross section.

Each fixed cutter in a working drag bit will have one or more working surfaces for engaging and fracturing a formation. Fixed cutters on drag bits, reamers and other rotating bodies for boring through rock will typically have at least a predominate portion of their primary cutting surface that is relatively, or substantially, planar or flat. In other aspects, the cutting surface is rounded, cone shaped, or some other shape. Thus, in some aspects, the primary cutting surface of the cutter is flat or relatively flat, while in others it may include bumps, ridges, spokes or other features that disrupt an otherwise substantially flat surface.

Each fixed cutter includes a cutting face comprising one or more surfaces that are intended to face and engage the formation, thereby performing the work of fracturing the formation. These surfaces will tend to experience the greatest reactive force from the formation. For cylindrically shaped cutters, the generally flat PCD layer of the cylinder functions as the primary cutting surface. Therefore, the orientation of this surface can be used to specify the orientation of the cutter on the bit using, for example, a vector normal to the plane of this surface, as well as a vector in the plane of this surface. On a PDC cutter, for example, the primary cutting surface may comprise a top relatively flat surface of the layer of PCD (the table). The cutter surface includes a central or longitudinal "surface axis" extending therethrough in a direction normal to the cutting surface. In addition, each cutter includes a "cutter axis" which extends through the longitudinal axis of the cutter itself. As described below, the surface axis and cutter axis will coincide with one another for longitudinally symmetrical cutters (see, e.g., the cutters of FIGS. 3A and 3B). In other aspects, where the cutter is not entirely longitudinally symmetrical, the surface axis and cutter axis will not be aligned, as shown, for example, in FIGS. 4A-4C.

Exposed sides of the PCD table may perform some work and might be considered to be a working or cutting surface or form part of the cutting face. The outer perimeter of the PDC bits may also comprise, for example, an edge that is beveled or chamfered. Although the cutting surface may be flat or generally flat, in other aspects, the cutting surface may not be entirely flat, and may include one or more ridges, recesses, bumps or other features.

The concepts of cutting profile, back rake, and side rake are explained with reference to FIGS. 1-4. FIG. 1 represents a schematic illustration of a face view of a drill bit. The gauge of the bit is generally indicated by circle 10 and generally corresponds to the maximum width or diameter of the drill bit. For clarity, only five fixed cutters 12, 14, 15, 17, and 19 are illustrated in FIG. 1, although it will be appreciated that drill bits typically include many additional cutters. For purpose of illustration, cutters 12 and 14 are shown having different side rake angles but do not have any back rake. Cutters 15 and 17 are shown having different back rake angles but do not have any side rake. Cutter 19 is shown having neither back rake nor side rake. Although not shown, it is contemplated that a cutter may have both back rake and side rake.

Reference number 18 identifies the center of rotation or longitudinal axis of the drill bit, referred to herein as the "bit axis." Radial line 20 is an arbitrary radial selected to represent zero degree angular rotation around bit axis 18. Fixed cutters 12 and 14 are located generally on the same radial line 22, at the same angular rotation, as indicated by angle 24, but are radially displaced at different distances, 26 and 28, from the bit axis 18. Fixed cutters 15 and 17 are located generally on the same radial line 31, at the same angular rotation, as indicated by angle 34, but are radially displaced at different distances, 35 and 37, from the bit axis 18. Cutters 12 and 14 are located on one blade, and cutters 15 and 17 are located on another blade. For clarity, the blades are not indicated on the schematic representation of FIG. 1. Cutters on the same blade may or may not all lie on the same radial line or at the same angular rotation around bit axis 18. For example, cutters may be aligned on a given blade in a straight radial line or may be aligned in a curved (arcuous) path along a given blade. Cutter 19 lies on the radial line 32, which has a substantially greater angular position than the other cutters. As shown, its radial displacement from the bit axis 18 is greater than the distances of the other four cutters 12, 14, 15, and 17.

a. Cutting Profile

Figure 2:
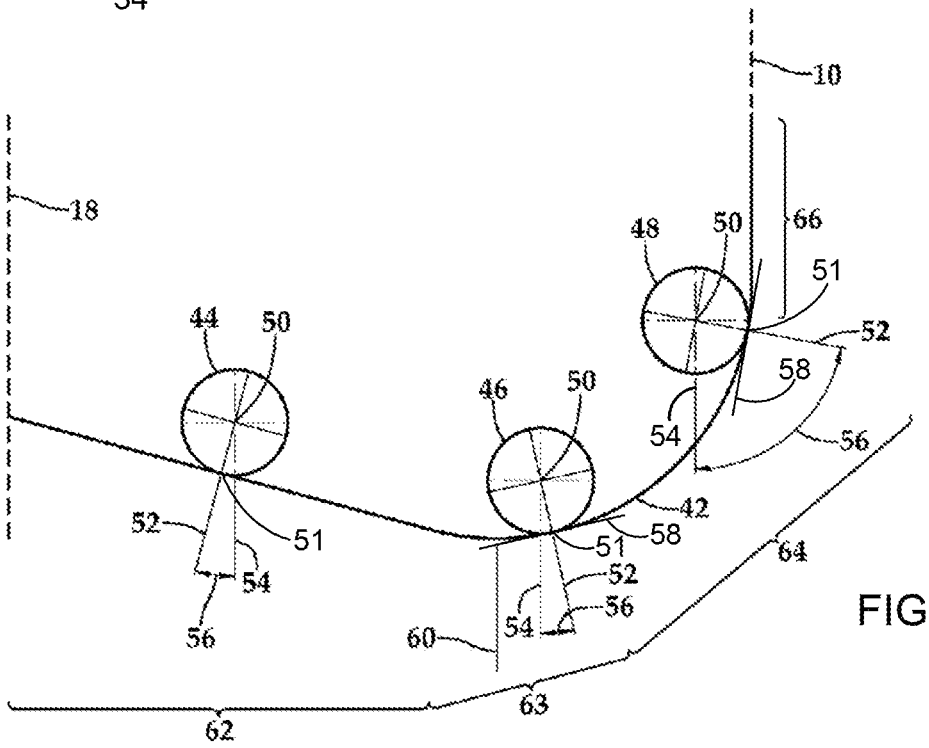
FIG. 2 represents a schematic illustration of a cutting profile of a drill bit, in accordance with some embodiments of the present invention.

FIG. 2 represents a schematic illustration of a cutting profile of a bit. Only three fixed cutters are illustrated for sake of clarity, with the outer diameters of the individual cutters represented by circular outlines 44, 46, and 48, respectively. The profiles of the cutters are formed by rotating their positions to the zero degree angular rotation radial line 20 (FIG. 1) and projecting them into a plane in which the bit axis and the zero degree angular rotation radial line 20 lie. Curve 42, which represents the cutting profile of the bit, touches each cutter at one point, and generally represents the intended cross-sectional shape in the borehole left by the bit as it is penetrating the formation. For purposes of simplifying the illustration, each of the outlines 44, 46 and 48 assumes that the cutters do not have any back rake or side rake. If a cutter had any back rake, such as cutters 15 and 17, or side rake, such as cutters 14 and 16, the projection of the outside diameter of the PCD layer into a plane through the radial line for that cutter would be elliptical.

b. Side Rake Angle

The cutters in FIG. 2 are shown "face on" and have longitudinal symmetry such that point 50 (three are shown, one for each cutter) represent both the cutter axis and the surface axis, which coincide with one another. As shown, cutter/surface axis 50 will be selected, for purposes of example, as the origin of a reference frame for defining side rake of the cutter in the following description.

Line 52 represents the "side rake axis," which is the axis about which the cutter is rotated to establish side rake. The side rake axis 52 is normal to the tangent of the cutting profile at the point 51 where the projection of the cutter diameter 44, 46, 48 touches the bit cutting profile curve 42, and extends through point 50. Side rake axis 52 also lies on the front surface of the cutting surface. The angle of rotation (not indicated in FIG. 2) of a cutter about the side rake axis 52 is its "side rake angle," which is defined as the angle between (1) a line tangent to a circle of rotation for a given cutter, extending through point 50, and (2) the surface axis.

Referring back to FIG. 1, the cutters 12 and 14 are shown having different amounts of side rake, which are indicated by angles 36 and 38, respectively. In the case of cutter 12, the side rake angle 36 is defined between (i) line 41, which is tangent to a circle of rotation for cutter 12, extending through point 50, and (ii) the surface axis 43 of cutter 12. The side rake angle 38 of the cutter 14 is defined between (i) line 45, which is tangent to a circle of rotation for cutter 14, extending through point 50, and (ii) the surface axis 47 of cutter 14.

As shown in FIG. 1, the rotation of cutter 12 about its side rake axis 52 is opposite to the rotation of cutter 14 about its side rake axis 52. For cutter 12, its surface axis 43 is rotated about the side rake axis 52 toward the bit axis 18, and its cutter face defines a cutting surface that is angled toward the gauge circle 10 of the bit. For cutter 14, its surface axis 47 is rotated about the side rake axis 52 away from the axis of rotation 18 and towards the gauge circle 10 of the bit, and its cutter face defines a cutting surface angled toward the bit axis 18. Accordingly, cutters 12 and 14 face toward each other and have side rakes that converge on one another.

As discussed above, the three cutters shown in FIG. 2 and cutter 19 have no side rake, or a zero degree side rake angle. As convention, rotation of the cutter from the zero degree side rake position to angle the cutter face towards gauge 20 of the bit establishes a positive side rake angle. Rotation of the cutter from the zero degree side rake position to angle the cutter face towards the bit axis 18 of the bit establishes a negative side rake angle. Accordingly, cutter 12 has a positive side rake angle, and cutter 14 has a negative side rake angle.

c. Back Rake Angle

The "back rake axis" for a given cutter is defined as the tangent of the cutting profile curve 42 at the point 51 where the projection of the cutter touches the bit cutting profile curve 42. The back rake axis 58 for a given cutter is thus orthogonal to both the cutter axis and the cutter's side rake axis 52. Line 58 for cutters 46 and 48 in FIG. 2 represents each cutter's back rake axis. The back rake axis 58 for cutter 44 is not labeled because its back rake axis 58 and the cutting profile curve 42 substantially overlap. Rotation (not indicated in FIG. 2) of the cutter around its back rake axis 58 establishes its "back rake angle," which is defined as the angle between (1) a line normal to the cutting profile at the point (e.g., point 51) where the projection of the cutter diameter touches the bit cutting profile (e.g., curve 42) and (2) a line in the plane of the cutting surface extending through the center point 50 of the cutting surface.

Figure 3B:
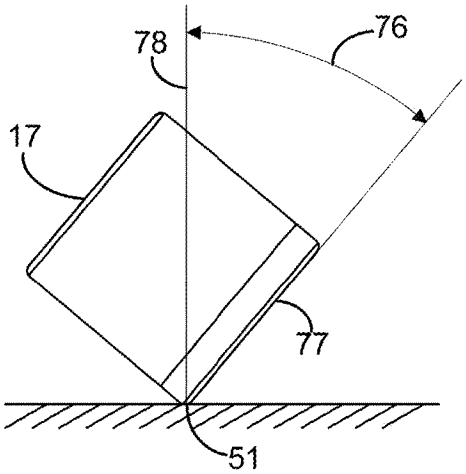
FIG. 3B shows a schematic illustration of another cutter having a positive back rake angle, in accordance with some embodiments of the present invention.
Figure 3A:
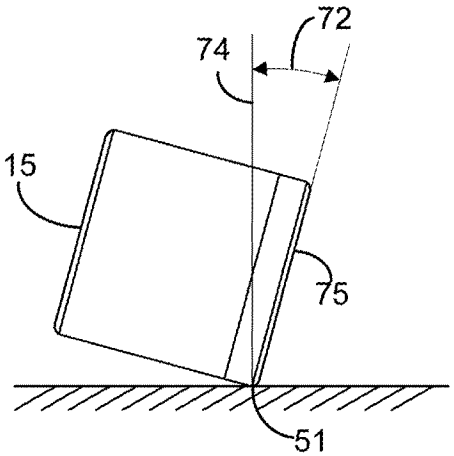
FIG. 3A shows a schematic illustration of a cutter having a positive back rake angle, in accordance with some embodiments of the present invention.
Figure 4C:
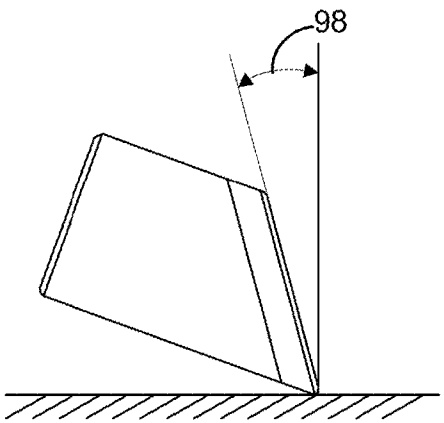
FIG. 4C shows a schematic illustration of a cutter having a negative back rake angle, in accordance with some embodiments of the present invention.

Cutters 15 and 17 in FIG. 1 are shown to have different amounts or degrees of back rake, and are also shown in FIGS. 3A and 3B, respectively. In the case of cutter 15, the back rake angle 72 is defined between line 74, which is normal to the cutting profile (or formation surface) at contact point 51, and a line in the plane of the cutting surface 75 extending through the center point thereof. In the case of cutter 17, the back rake angle 76 is defined between line 78, which is normal to the cutting profile (or formation surface) at contact point 51 and a line in the plane of cutting surface 77 extending through the center point thereof. In FIGS. 3A and 3B, the contact point 51 and each cutter's back rake axis 58 overlap.

When the cutter face or surface is aligned with the vector normal to the cutting profile, that cutter is said to have zero back rake or a "zero degree" back rake angle. The three cutters shown in FIG. 2 and cutter 19 shown in FIG. 1 have zero degree back rake angles. When the rotation of the cutter about its back rake axis 58 angles the cutter face towards the formation leading the cutter along the direction of bit rotation, the rotation about the back rake axis 58 establishes a positive back rake angle for that cutter. When the rotation of the cutter about its back rake axis 58 angles the cutter face away from the formation leading the cutter along the direction of bit rotation, the rotation about the back rake axis 58 is said to have a negative back rake angle for that cutter.

Both the rotation of cutter 15 and the rotation of cutter 17 about their respective back rake axes 58 angle the respective cutting surfaces 75 and 77 forward along the direction of bit rotation toward the formation. Thus, cutters 15 and 17 each have a positive back rake angle. Cutter 17 has a greater back rake angle 76 than back rake angle 72 of cutter 15. Comparatively speaking, a cutter having a lesser positive back rake angle is said to have a more aggressive back rake angle than a cutter having a greater positive back rake angle. In a pair of cutters that have different positive back rake angles, the cutter with the lesser back rake angle may be referred to as the aggressive cutter, and the cutter with the greater back rake angle may be referred to as the passive cutter, relative to one another.

Figure 4B:
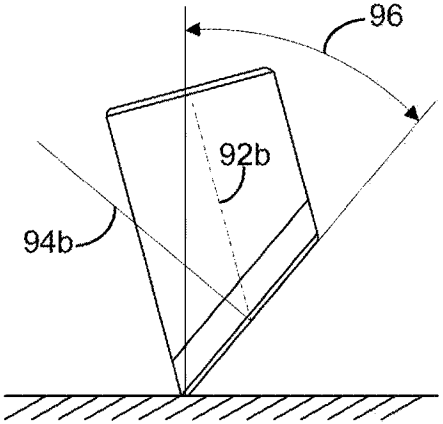
FIGS. 4A and 4B show schematic illustrations of two different cutters having a common positive back rake angle, in accordance with some embodiments of the present invention.
Figure 4A:
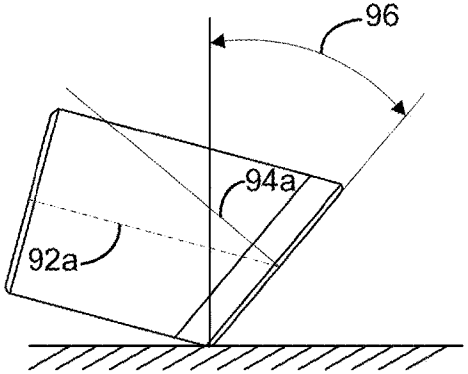

In the embodiments shown in FIGS. 3A and 3B, the surface axis aligns with the cutter axis. In some embodiments, as discussed above, the cutter may not be longitudinally symmetrical, resulting in a cutter axis that is slanted or angled relative to the cutting surface. FIGS. 4A and 4B show cutters having cutter axes 92*a* and 92*b* of their respective cutters that do not align with the respective surface axes 94*a* and 94*b* of the cutter surfaces. Moreover, cutter axes 92*a* and 92*b* are slanted or angled relative to their respective cutting surfaces. The same back rake angle 96, however, may be achieved by mounting the cutters on the bit body at different mounting angles. Having the cutter axis slanted or angled with respect to the cutting surface may facilitate establishing a negative back rake angle, such as negative back rake angle 98 shown in FIG. 4C.

d. Cone, Nose, Shoulder, and Gauge

Referring back to FIG. 2, angle 56 between the side rack axis 52 and line 54, which crosses the cutter's cutter axis and is parallel to the bit axis 18, defines the "cutting profile angle," as measured in a clock-wise direction. Line 60 represents the zero angle for the cutting profile. Section 62 of the cutting profile corresponds to the cone of a PDC bit. The profile angles in this section are somewhere between 270 degrees and 360 (or zero) degrees. The profile angles increase toward 360 degrees starting from the bit axis 18 and moving toward the 360 or zero degree profile angle at line 60. The bit's nose corresponds generally to section 63 of the cutting profile, and is disposed radially outward from the cone section. In the nose section, the profile angles are close to zero degrees. Portion 64 of the profile corresponds to the bit's shoulder section, and is disposed radially outward from the nose section. The profile angles increase quickly in this section until they reach 90 degrees. Section 66 of the cutting profile corresponds to the bit's longitudinally extending gauge section. The cutting profile angle in the gauge section is approximately 90 degrees.

III. Drill Bit with Multiple Cutting Profiles

Figure 5:
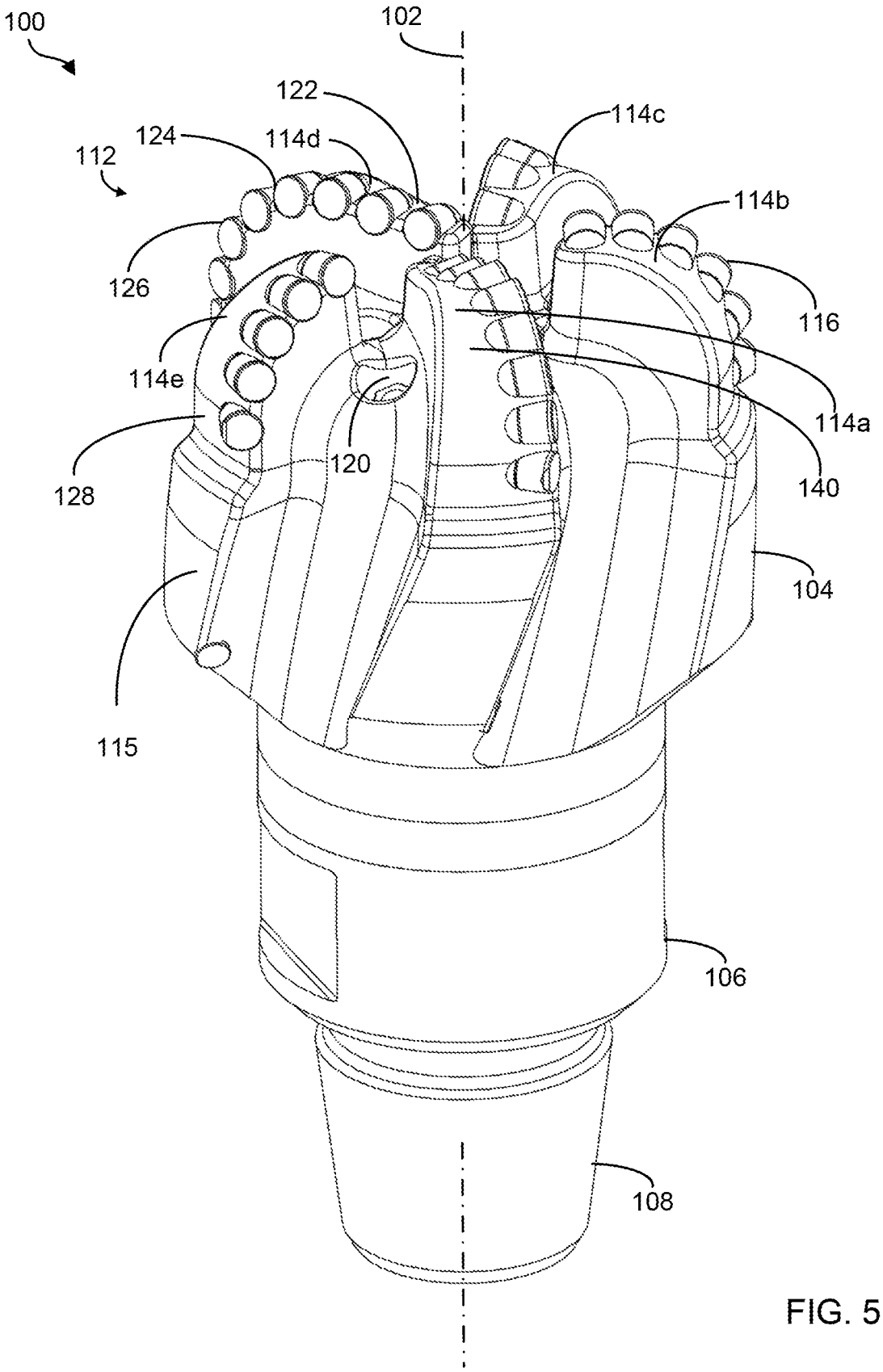
FIG. 5 shows a side perspective view of a drill bit in accordance with some embodiments of the present invention.
Figure 6:
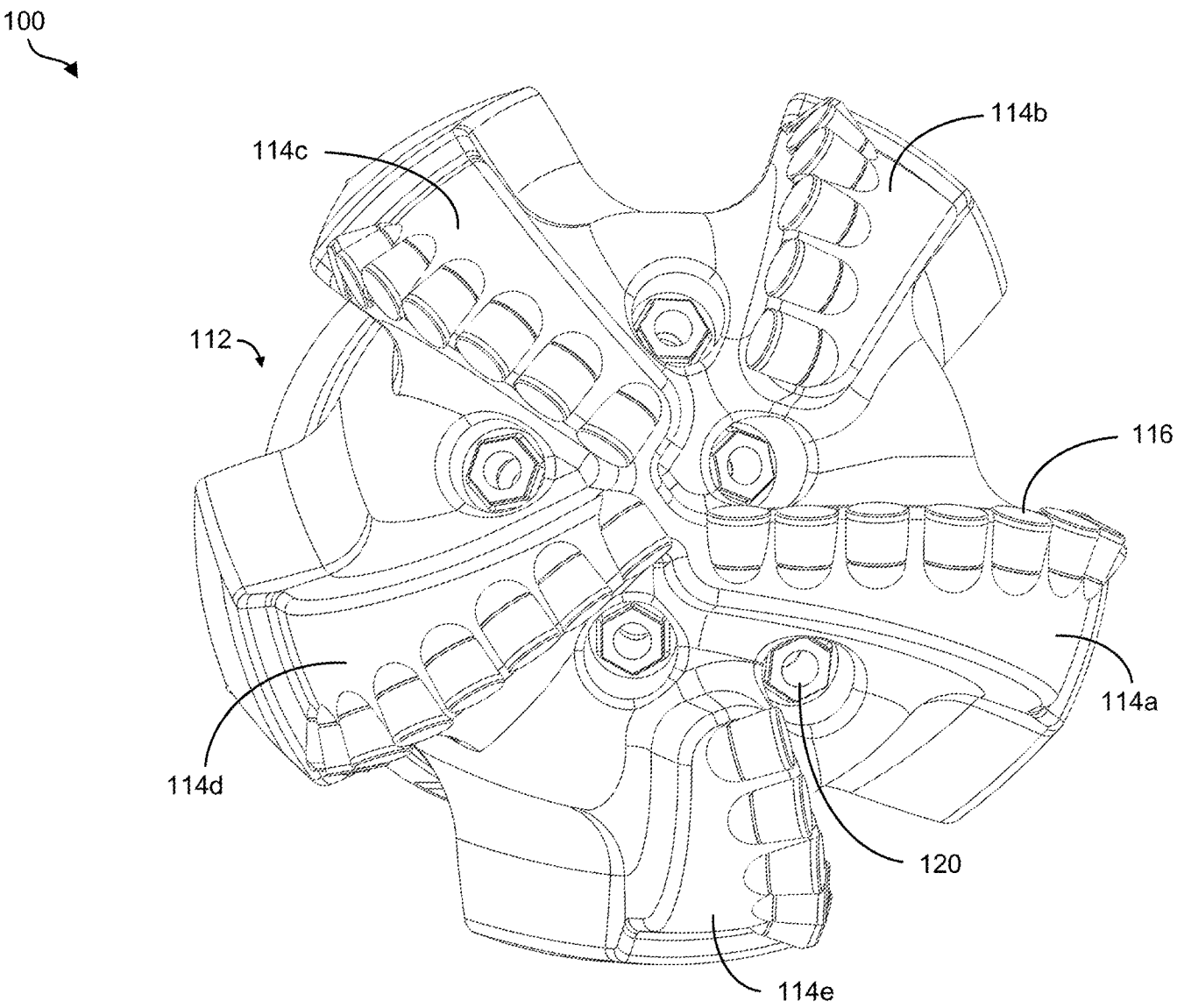
FIG. 6 shows a face view of the drill bit of FIG. 5, in accordance with some embodiments of the present invention.

Referring to FIGS. 5 and 6, there are shown some embodiments of a drill bit 100, and more specifically, a rotary drag bit with PDC cutters. FIGS. 5 and 6 illustrate the side perspective view and face view of the drill bit 100, respectively. The drill bit 100 is designed to be rotated around its central bit axis 102 as shown in FIG. 5.

In some embodiments, drill bit 100 may include, but is not limited to, a bit body 104 connected to a shank 106 and a tapered threaded coupling 108 for connecting the bit to a drill string. The exterior surface of bit body 104 that is intended to face generally in the direction of boring is referred to as the face of drill bit 100 and is generally designated by reference number 112.

Disposed on the bit face 112 are a plurality of raised blades 114*a*-114*e* separated by channels or "junk slots" between blades 114*a*-114*e*. Each blade 114 extends generally in a radial direction, outwardly to the periphery of face 112 of drill bit 100. In this example, there are six blades 114 spaced around the bit axis 102, and each blade 114 sweeps or curves backwardly relative to the direction of rotation. All six blades 114 in this example either start or have a segment or section on the nose 124 of the bit body 104, in which the angle of the cutting profile is close to zero, a segment along the shoulder 126 of the bit body 104, which is characterized by increasing profile angles, and a segment on the gauge 128. Bit body 104 includes a plurality of gauge pads 115 located at the end of each of the blades 114. Blades 114*a* 114*c*, and 114*d* in this particular example have segments or sections located along the cone 122 of the bit body 104. Blades that extend into the cone 122 of the bit body 104 may be referred to as blades to center. In various embodiments, bit 100 could have a different numbers of blades 114, different number of blades to center, different blade lengths and/or locations.

Disposed on each blade 114 is a row of discrete primary cutting elements, or primary cutters 116, that collectively are part of the bit's primary cutting profile, which will be described in more detail below. In some embodiments, one or more blades 114 may also include back-up cutters that are disposed in a secondary row trailing a row of primary cutters on the same blade 114. The secondary row of back-up cutters may be disposed, for example, in region 140 of blade 114*a*. Although only one region 140 is labeled in FIG. 5 on blade 114*a*, one or more of the other blades 114*b*-114*e* may also each include a secondary row of back-up cutters. The secondary row or set of back-up cutters often, collectively, form a cutting profile for the bit 100 that is different from the primary cutting profile. The cutting profile defined by the back-up cutters generally does not coincide with or intersect the primary cutting profile. In some embodiments, both primary cutters 116 and back-up cutters are PDC cutters, with a wear or cutting surface made of super hard, polycrystalline diamond, or the like, supported by a substrate that forms a mounting stud for placement in each pocket formed in the blade 114. Nozzles 120 are positioned in the body to direct drilling fluid along the cutting blades 114 to assist with evacuation of rock cuttings or chips and to cool the primary cutters 116 and the back-up cutters.

Conventionally, primary cutters of a drill bit typically collectively form a single, continuous, smooth primary cutting profile across the cone 122, nose 124, shoulder 126, and gauge 128 of the bit body 104. The primary cutters 116 in the embodiments described herein define a hybrid or combination primary cutting profile that includes multiple cutting profiles. For example, some of the primary cutters 116 may define a first cutting profile that may be a continuous, smooth cutting profile in the cone 122, nose 124, shoulder 126, and gauge 128 of the bit body 104. Some of the primary cutters 116 may define a second cutting profile that may coincide with or interest the first cutting profile. In some embodiments, the second cutting profile may also be a continuous, smooth cutting profile. As used herein, the term "intersect" means to touch at a single point. In the context of first and second cutting profiles, a first profile intersects a second profile if it touches a single point of the second profile when the two profiles are superimposed on one another. A profile may intersect another profile at one or more than one discreet location. At the point of intersection, there may be only one cutter disposed at the point of intersection, and that cutter may be from the first and/or second profile. As used herein, the term "coincide" means to be aligned along at least a portion of a profile, more than at a single point. In the context of first and second cutting profiles, a first profile coincides, at least in part, with a second profile if it is aligned, at least in part, with the second profile when the two profiles are superimposed on one another. There may be multiple cutters disposed along an overlapping or coinciding portion of the first and second cutting profiles. Those cutters are common to both the first and second cutting profiles. In some embodiments, the primary cutting profile may further include a third, fourth, and additional cutting profiles defined by the primary cutters 116 that may coincide with or intersect the first, second, and/or other cutting profiles of the primary cutting profile.

Figure 7:
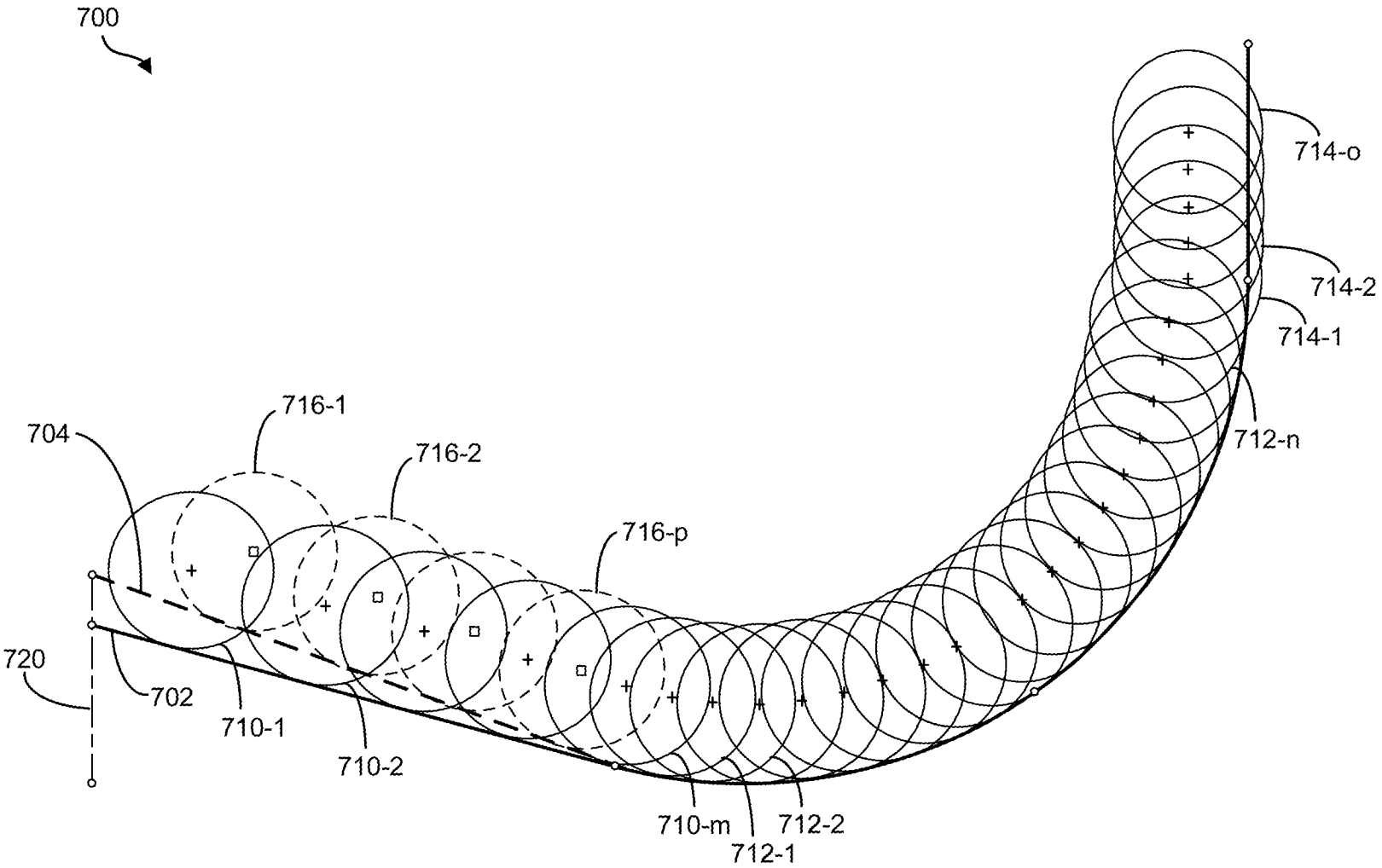
FIG. 7 shows an example of a hybrid or combination primary cutting profile, in accordance with some embodiments of the present invention.

Referring to FIG. 7, an example of a hybrid or combination primary cutting profile 700 is shown. The primary cutting profile 700 may include a first cutting profile 702 and a second cutting profile 704 different from the first cutting profile 702. The first cutting profile 702 may be defined by primary cutters 710-1, 710-2, . . . , **710-*m* in the cone region, primary cutters 712-1, 712-2, . . . , 712-*n* in the nose and shoulder regions, and primary cutters or gauge cutters 714-1, 714-2, . . . , 714-*o* in the gauge of the bit body. The second cutting profile 704 may be defined by primary cutters 716-1, 716-2, . . . , 716-*p* (shown in dash line) in the cone region, the primary cutters 712-1, 712-2, . . . , 712-*n* in the nose and shoulder regions, and the gauge cutters 714-1, 714-2, . . . , 714-*o*. Thus, in the embodiment shown, the first cutting profile 702 and the second cutting profile 704** are different in the cone region but coincide with each other in the nose, shoulder, and gauge regions.

It is noted that portions of the gauge cutters 714 in the gauge region that protrude beyond the first and/or second cutting profiles 702,704 do not form a portion of the first and/or second cutting profiles 702, 704 because the protruding portions of the gauge cutters 714 are subsequently removed by, e.g., grinding, prior to use. Such subsequent removal ensures that a tight tolerance of the diameter of the drill bit is met. Although five primary cutters 710 and four primary cutters 716 are illustrated in the cone region, a greater or lesser number of the primary cutters 710 and/or the primary cutters 716 may be present in the cone region in various embodiments. Similarly, there may be any suitable number of primary cutters 712, 714 in the nose, shoulder, and/or gauge regions.

The first cutting profile 702 defines a smooth, continuous cutting profile throughout the cone, nose, shoulder, and gauge regions. The second cutting profile 704 may or may not be smooth throughout the cone, nose, shoulder, and gauge regions, although the second cutting profile 704 may have portions that are smooth and continuous in one or more of the cone, nose, shoulder, and gauge regions. For example, as shown in FIG. 7, the portion of the second cutting profile 704 in the cone region is smooth and continuous, and the portion of the second cutting profile 704 in the nose, shoulder, and gauge regions is smooth and continuous. Depending on the transition from one portion to another portion, e.g., the transition from the portion in the cone region to the portion in the nose region in the example shown in FIG. 7, the entire second cutting profile 704 throughout the cone, nose, shoulder, and gauge regions may be smooth and continuous in some embodiments, but may not be smooth and continuous in other embodiments.

In the example shown in FIG. 7, the first cutting profile 702 and the second cutting profile 704 define different cutting profile angles in the cone region. As mentioned above with reference to FIG. 2, the cutting profile angle is defined as the angle, measured in the clock-wise direction, between the side rake axis and the line crossing the cutter's cutter axis and parallel to the bit axis. Thus, the cutting profile angle of the second cutting profile 704 in the cone region is less than the cutting profile angle of the first cutting profile 702. In some embodiments, the difference between the cutting profile angles of the first and second cutting profiles 702, 704 in the cone region may range between 1° and 20°, e.g., between 2° and 18°, between 4° and 16°, between 6° and 14°, between 8° and 12°, between 1° and 10°, between 2° and 9°, between 3° and 8°, between 4° and 7°, between 5° and 6°, between 11° and 20°, between 12° and 19°, between 13° and 18°, between 14° and 17°, or between 15° and 16°. In some embodiments, in terms of upper limits, the difference between the cutting profile angles of the first and second cutting profiles 702, 704 may be less than 20°, e.g., less than 19°, less than 18°, less than 17°, less than 16°, less than 15°, less than 14°, less than 13°, less than 12°, less than 11°, less than 10°, less than 9°, less than 8°, less than 7°, less than 6°, less than 5°, less than 4°, less than 3°, less than 2°, less than 1°, or less. In some embodiments, in terms of lower limits, the difference between the cutting profile angles of the first and second cutting profiles 702, 704 may be at least 1°, e.g., at least 2°, at least 3°, at least 4°, at least 5°, at least 6°, at least 7°, at least 8°, at least 9°, at least 10°, at least 11°, at least 12°, at least 13°, at least 14°, at least 15°, at least 16°, at least 17°, at least 18°, at least 19°, at least 20°, or greater.

Because the portions of the first and second cutting profiles 702, 704 in the cone region are substantially straight, the first cutting profile 702 and the second cutting profile 704 also define different slopes in the cone region. The difference between the slopes of the first and second cutting profiles 702, 704 corresponds to the difference between the cutting profile angles of the first and second cutting profiles 702, 704. In the example shown in FIG. 7, the second cutting profile 704 defines a greater slope in the cone region than the first cutting profile 702. Thus, the second cutting profile 704 is axially recessed relative to the first cutting profile 702 in the cone region, or the first cutting profile 702 protrudes axially relative to the second cutting profile 704 in the cone region.

There are several advantages provided by having the second cutting profile 704 recessed relative to the first cutting profile 702 in the cone region. When designing a drill bit, it is believed that having one or more blades, typically three, to extend into the center or cone region of the drill bit stabilizes the drill bit during drilling. The blades that extend into the cone region of the drill bit are referred to as blades to center. Increasing the number of blades to center, however, may reduce the drilling speed or ROP due to the increased number of cutters in the cone region.

By implementing multiple cutting profiles in the cone regions, an increased number of blades to center may be implemented for improved bit stability without negatively affecting the drilling speed. Specifically, when the number of blades to center is increased, some of the cutters from one or more of the blades to center may be recessed to form a second cutting profile having a recessed cutting profile portion, similar to the second cutting profile 704 shown in FIG. 7. The cutters on the recessed portion of the cutting profile may not engage the rock formation or engage the rock formation to a lesser degree as compared to the cutters on a protruding profile portion, such as the profile portion of the second cutting profile 704 in the cone region. Thus, the bit weight may be distributed on an overall less number of cutters. Each cutter on the protruding profile may bear more weight load and thus cut more aggressively, yielding a higher ROP.

Improved bit stability can also be achieved because the cutters on the recessed profile portion may act as a form of depth of cut (DOC) control in the cone region for improved tool face control. Specifically, before the cutters on the protruding profile portion cut too deep into the formation, the cutters on the recessed profile portion may engage the formation, thereby protecting the drill bit from over-engagement and whirl. In some instances, over-engagement may be prevented by load limiters, which are configured to limit depth of cut and minimize torque variations. Once the bearing surfaces of the load-limiters reach the formation, however, the ROP may also be capped because load limiters are not configured to cut the formation. Different from load limiters, the cutters on the recessed profile portion engage and cut the formation, along with the cutters on the protruding profile portion. Thus, over-engagement may be prevented by the cutters on the recessed profile portion without capping the ROP.

Additional advantage associated with multiple cutting profiles may include improved durability. As mentioned above, when the drilling operation starts, the cutters on the protruding profile portion may first engage the formation while the cutters on the recessed profile portion may not engage the formation. Thus, as the drilling operation continues, wear or damage may first occur in the cutters on the protruding profile portion while the wear or damage in the cutters on the recessed profile portion may be limited. As the cutters on the protruding profile portion further wears down, the cutters on the recessed profile portion may then engage the formation and share the weight load. Thus, the cutters on the recessed profile portion may function as back-up cutters to the cutters on the protruding profile portion to achieve an increased bit operational life. It should be noted that the cutters on the recessed profile portion are not true back-up cutters, which typically refer to cutters that are disposed in a secondary row trailing a row of primary cutters on the same blade. In contrast, the cutters on the recessed profile portion are primary cutters, but may function to supplement the primary cutters on the protruding profile portion as the primary cutters on the protruding profile portion gradually wear down.

The cutters on the recessed profile portion may be disposed on a single blade or may be distributed on multiple blades. In some embodiments, the cutters forming the recessed profile portion may be from or disposed on a single blade. To form the recessed profile portion, the exposure of some or all of the cutters on that blade may be decreased as compared to the remaining cutters on that blade and/or the cutters on the other blades. Decreased exposure may be achieved by burying the cutters deeper into the blade. In some embodiments, the recessed cutters may be from or disposed on two or more of the blades. On each blade, some cutters may be underexposed as compared to the other cutters on the same blade.

In some embodiments, instead of or in addition to decreasing the exposure of the cutters, one or more blades may be axially recessed relative to the other blades. For example, one or more of the blades may be angled deeper in the cone region as compared to the other blades. Consequently, the cutters on the deeper blade may form the recessed profile portion. The difference in the blade angle among the blades may be similar to the difference in the cutting profile angle between the first and second cutting profiles 702, 704 as discussed above. In some embodiments, the difference in the blade angle may be less than the difference in the cutting profile angle between the first and second cutting profiles 702, 704 when the recessed profile portion may be achieved by implementing a deeper blade angle and additionally decreasing the exposure of the cutters on the recessed blade.

In some embodiments, each of the primary cutters on the recessed profile portion and each of the primary cutters on the protruding profile portion may be disposed at a different radial position or distance from the bit axis 720, such as shown in FIG. 7. In some embodiments, the radial positions of at least some of the primary cutters on the recessed profile portion may overlap with the radial positions of some of the primary cutters on the protruding profile portion. Primary cutters on the recessed profile portion and primary cutters on the protruding profile portion sharing common radial positions may be referred to as plural set cutters.

In some embodiments, all or a majority (e.g., greater than or about 50%) of the primary cutters on the recessed profile portion may be disposed on a common blade, and all or a majority of the primary cutters on the protruding profile portion may be disposed on another common blade. In some embodiments, all or a majority of the primary cutters on both the recessed profile portion and the protruding profile portion may be disposed on a common blade. In some embodiments, the primary cutters on the recessed profile portion may be disposed or distributed on multiple blades. In some embodiments, the primary cutters on the protruding profile portion may also be disposed or distributed on multiple blades. Some blades or at least portions thereof, e.g., the portions of the blades in the cone region, may include only primary cutters on the recessed profile portion. Some blades or at least portions thereof may include only primary cutters on the protruding profile portion. Some blades may include a combination of primary cutters on the recessed profile portion and primary cutters on the protruding profile portion. Similar to how the primary cutters on the recessed profile portion may function as back-up cutters to the primary cutters on the protruding profile portion, blades having some or all cutters on the recessed profile portion may function as back-up blades to blades having some or all cutters on the protruding profile portion.

In some embodiments, at least some or a majority of the primary cutters on the recessed profile portion and at least some or a majority of the primary cutters on the protruding profile portion may be arranged in an alternating manner along the cutting profile, such as shown in FIG. 7. In some embodiments, the alternating arrangement of the primary cutters on the recessed and protruding profiles may be present within a single blade.

In some embodiments, at least some of the primary cutters on the recessed profile portion may have back rake angles different from the back rake angles of at least some of the primary cutters on the protruding profile portion. The primary cutters on the protruding profile portion may have back rake angles within a first range, and the primary cutters on the recessed profile portion may have back rake angles within a second range different from the first range. In some embodiments, the first range may include positive back rake angles greater than the maximum back rake angle of the second range, and the second range may include positive back rake angles less than the minimum back rake angles of the first range. The first range and the second range may or may not overlap. For example, in some embodiments, the first range of back rake angle may be from 5° to 45°, e.g., from 5° to 15°, from 5° to 20°, from 10° to 25°, from 15° to 30°, from 15° to 35°, from 20° to 35°, from 25° to 40°, or from 30° to 45°, and the second range of back rake angle may be from 5° to 45°, e.g., from 5° to 15°, from 5° to 20°, from 10° to 25°, from 15° to 30°, from 15° to 35°, from 20° to 35°, from 25° to 40°, or from 30° to 45°. Thus, at least some of the primary cutters on the recessed profile portion may be more aggressive than the primary cutters on the protruding profile portion. By placing the more aggressive cutters on the recessed profile portion, the more aggressive cutters may be protected from excessive wear. In some embodiments, the more aggressive cutters may be placed on the protruding profile portion based on various other considerations.

In some embodiments, the primary cutters on the protruding profile portion and the primary cutters on the recessed profile portion may also have different side rake angles. For example, the primary cutters on the protruding profile portion may have side rake angles within a first range, e.g., from −15° to 25°, from −15° to 0°, from −10° to 0°, from −5° to 0°, from −10° to 5°, from −5° to 10°, from 0° to 5°, from 0° to 10°, from 0° to 15°, from 0° to 20°, from 0° to 25°, from 5° to 20°, or from 10° to 25°, and the primary cutters on the recessed profile portion may have side rake angles within a second range, e.g., from −15° to 25°, from −15° to 0°, from −10° to 0°, from −5° to 0°, from −10° to 5°, from −5° to 10°, from 0° to 5°, from 0° to 10°, from 0° to 15°, from 0° to 20°, from 0° to 25°, from 5° to 20°, or from 10° to 25°.

Figure 8:
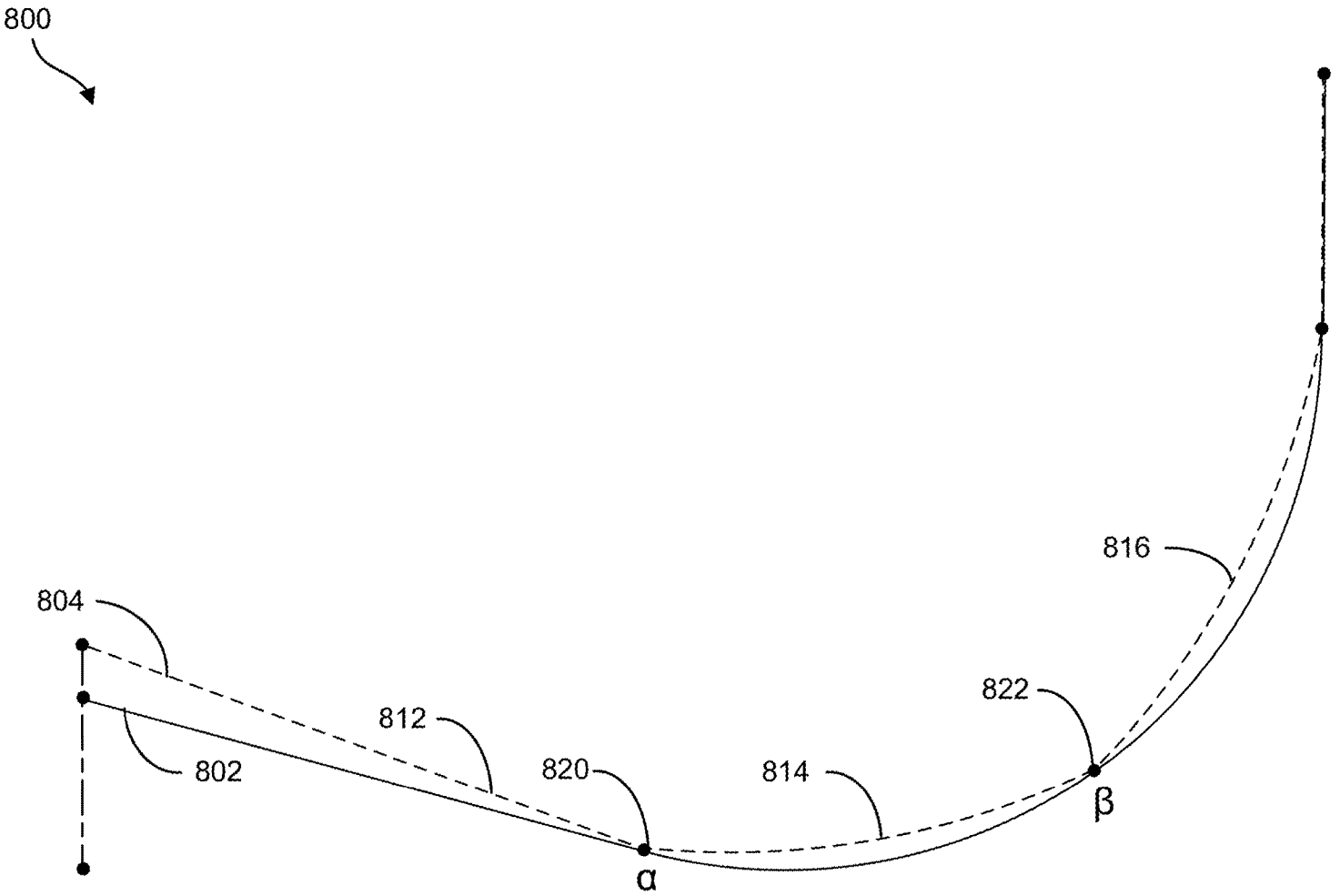
FIG. 8 shows another example of a hybrid or combination primary cutting profile, in accordance with some embodiments of the present invention.
Figure 9:
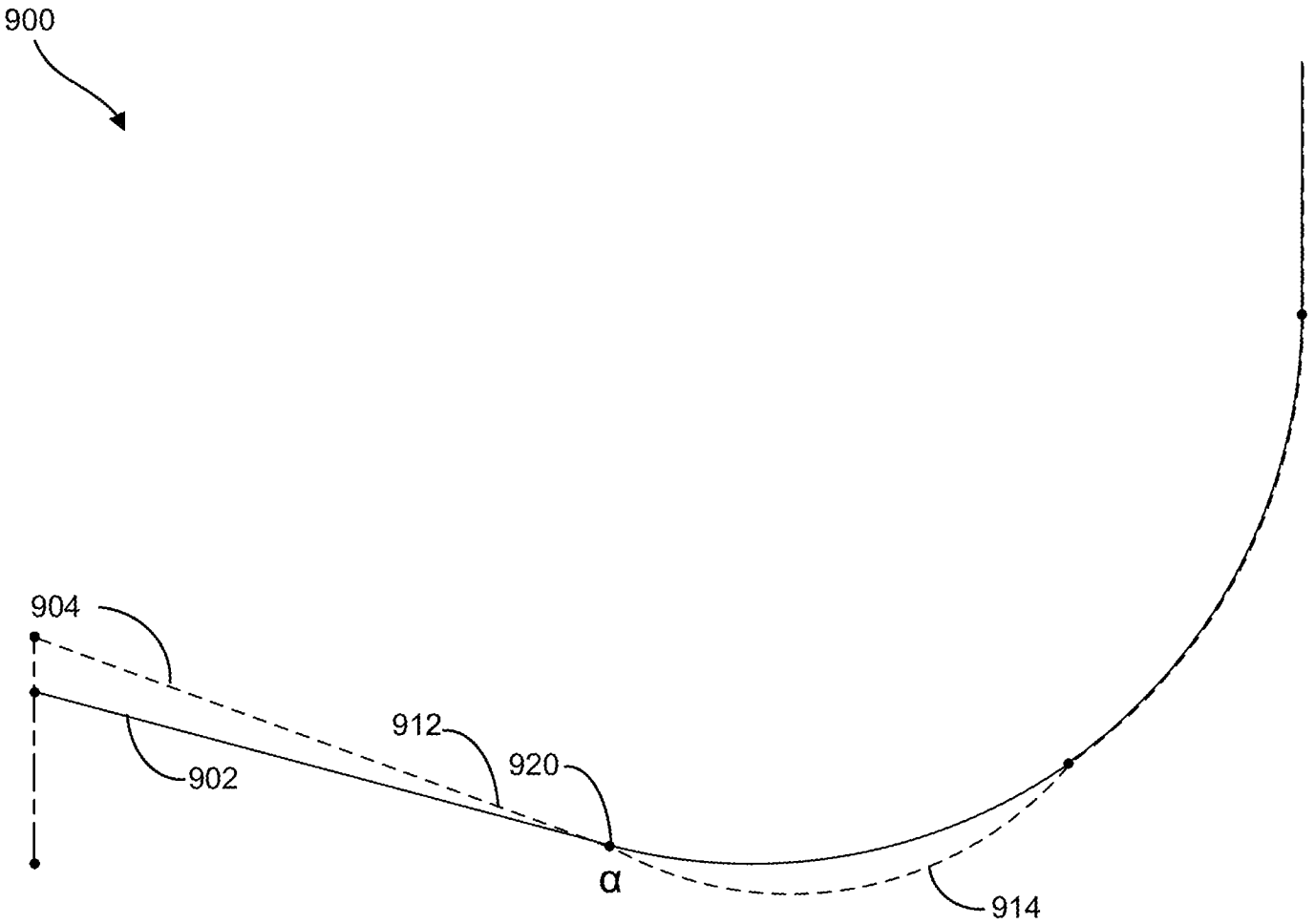
FIG. 9 shows a further example of a hybrid or combination primary cutting profile, in accordance with some embodiments of the present invention.
Figure 10:
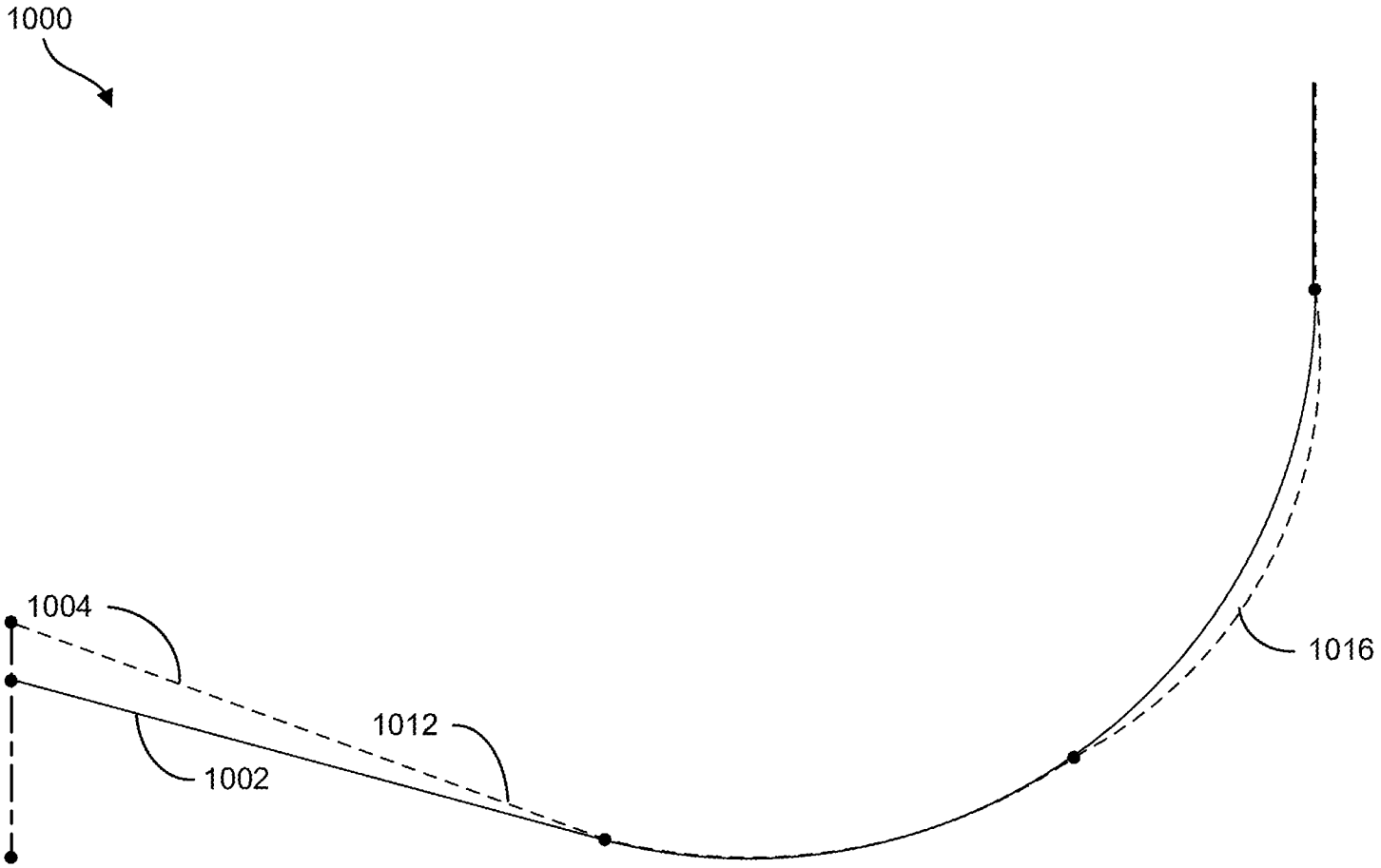
FIG. 10 shows yet another example of a hybrid or combination primary cutting profile, in accordance with some embodiments of the present invention.

FIGS. 8-10 schematically illustrate additional examples of a hybrid or combination primary cutting profile. Similar to the cutting profile shown in FIG. 7, the exemplary cutting profiles shown in FIGS. 8-10 each include two cutting profile portions in the cone region. Different from the example shown in FIG. 7, the examples shown in FIGS. 8-10 may also include multiple cutting profile portions in one or both of the nose and/or shoulder regions as discussed below.

With reference to FIG. 8, the primary cutting profile 800 includes a first cutting profile 802 and a second cutting profile 804 (shown in dash line). The first cutting profile 802 defines a smooth, continuous cutting profile throughout the cone, nose, shoulder, and gauge regions. The second cutting profile 804 may include a first profile portion 812 in the cone region, a second profile portion 814 in the nose region, and a third profile portion 816 in the shoulder region that do not coincide with the first cutting profile 802. As shown, the second cutting profile 804 and the first cutting profile 802 coincide with each other in the gauge region. The first cutting profile 802 intersects the second cutting profile 804 at transition point α 820 from the cone region to the nose region and at the transition point β 822 from the nose region to the shoulder region.

The first, second, and third profile portions 812, 814, 816 are each axially recessed relative to the corresponding portions of the first cutting profile 802 in the cone, nose, and shoulder regions, respectively. The third profile portion 816 is also radially recessed relative to the corresponding portion of the first cutting profile 802 in the shoulder region. The first profile portion 812 and the corresponding portion of the first cutting profile 802 in the cone region define different slopes in the cone region. The second profile portion 814 and the third profile portion 816 each define a profile curvature different from the profile curvature of the corresponding portions of the first cutting profile in the nose and shoulder regions, respectively.

With reference to FIG. 9, another example of a hybrid or combination primary cutting profile 900 is shown. The primary cutting profile 900 includes a first cutting profile 902 and a second cutting profile 904 (shown in dash line). The first cutting profile 902 defines a smooth, continuous cutting profile throughout the cone, nose, shoulder, and gauge regions. The second cutting profile 904 may include a first profile portion 912 in the cone region and a second profile portion 914 in the nose region that do not coincide with the first cutting profile 902. The second cutting profile 904 and the first cutting profile 902 coincide with each other in the shoulder and gauge regions. The first cutting profile 902 intersects the second cutting profile 904 at the transition point α 920 from the cone region to the nose region.

The first profile portion 912 is axially recessed relative to the corresponding portion of the first cutting profile 902 in the cone region. The second profile portion 914 protrudes or extends axially beyond the corresponding portion of the first cutting profile in the nose region. To form a protruding profile portion, such as the protruding profile portion 914, the exposure of some or all of the cutters on the protruding profile portion may be increased. Alternatively or additionally, one or more blades may protrude axially beyond the other blades in the nose region, and at least some or all of the cutters on the protruding blade portions may form the protruding profile portion.

With reference to FIG. 10, another example of a hybrid or combination primary cutting profile 1000 is shown. The primary cutting profile 1000 includes a first cutting profile 1002 and a second cutting profile 1004 (shown in dash line). The first cutting profile 1002 defines a smooth, continuous cutting profile throughout the cone, nose, shoulder, and gauge regions. The second cutting profile 1004 may include a first profile portion 1012 in the cone region and a second profile portion 1016 in the shoulder region that do not coincide with the first cutting profile 1002. The second cutting profile 1004 and the first cutting profile 1002 coincide with each other in the nose and gauge regions. The first profile portion 1012 is axially recessed relative to the corresponding portion of the first cutting profile 1002 in the cone region. The second profile portion 1016 protrudes or extends axially and radially beyond the corresponding portion of the first cutting profile in the shoulder region.

As another example, in some embodiments, the primary cutting profile may include a first cutting profile that defines a smooth, continuous cutting profile throughout the cone, nose, shoulder, and gauge regions, and a second cutting profile that includes profile portions protruding beyond the first cutting profile in the nose and shoulder regions and a profile portion recessed relative to the first cutting profile in the cone region. The second profile portion may intersect the first cutting portion at the transition point $\alpha$ between the cone region and the nose region and at the transition point $\beta$ between the nose region and the shoulder region.

As yet another example, in some embodiments, the primary cutting profile may include a first cutting profile that defines a smooth, continuous cutting profile throughout the cone, nose, shoulder, and gauge regions, and a second cutting profile that includes profile portions protruding beyond the first cutting profile in the cone, nose, and shoulder regions. The second profile portion may intersect the first cutting portion at the transition point $\alpha$ between the cone region and the nose region and at the transition point $\beta$ between the nose region and the shoulder region.

The recessed or protruding configuration of different profile portions may be implemented to achieve different effects. For example, as discussed above, implementing multiple cutting profiles in the cone region may improve bit stability without negatively affecting ROP. Generally, by arranging some of the primary cutters to be axially and/or radially offset relatively to other primary cutters in a region, the bit may cut or engage the formation more aggressively in that region at least initially, thereby achieving a higher ROP. When the more aggressive cutters gradually wear, the recessed cutters supplement the aggressive cutter and spread out the weight load to prolong the bit operational life. This way, improved durability may be achieved.

Similar to primary cutters forming the different profile portions in the cone regions discussed above, the primary cutters forming the protruding or recessed profile portions in each of the nose or shoulder region may be disposed on the same or different blades, may occupy different or common radial positions, may be arranged in an alternating manner, and/or may include different back rake angles and/or different side rake angles.

Although examples of primary cutting profiles that include two cutting profiles are described herein, more than two, such as three, four, or any number of cutting profiles may be implemented in a hybrid or combination primary cutting profile by varying the exposure of the cutters and/or varying the angles of the blades in one or more of the cone, nose, and/or shoulder regions. More than one blade may be angled differently from the other blades to form one or more of the recessed or protruding cutting profile portions.

Figure 11:
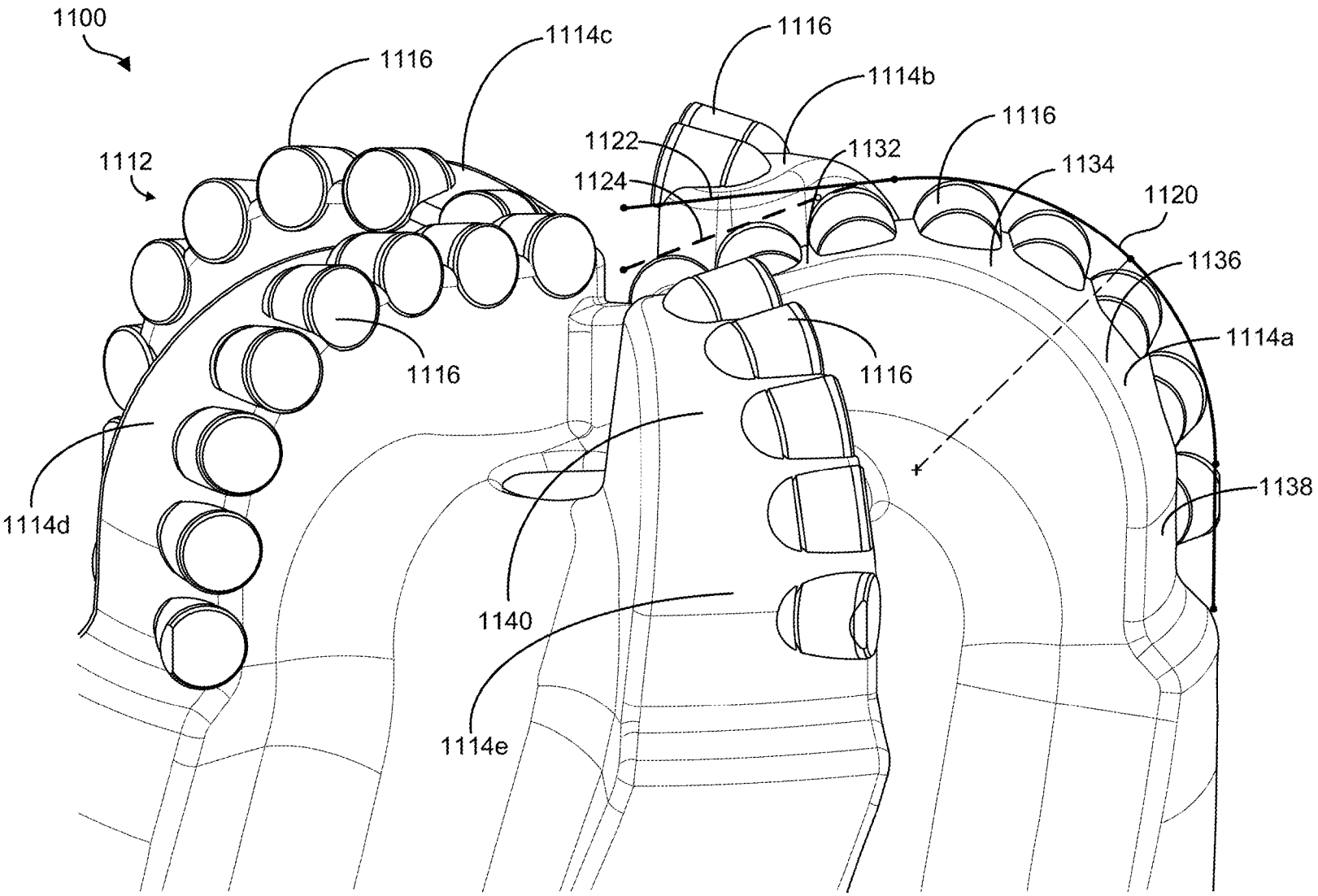
FIG. 11 schematically illustrates an exemplary drill bit having cutters defining a hybrid or combination primary cutting profile comprising multiple cutting profiles in accordance with some embodiments of the present invention.

FIG. 11 schematically illustrates an exemplary drill bit 1100 having cutters defining a hybrid or combination primary cutting profile 1120 comprising multiple cutting profiles. The drill bit 1100 may include blades 1114*a*-1114*e* disposed on the bit face 1112. Each of the blades 1114 include a row of cutters 1116, more specifically, a row of primary cutters 1116 disposed at a leading edge of each blade 1114. In some embodiments, one or more blades 1114 may include a secondary row or set of back-up cutters trailing the row of primary cutters 1116. The secondary row of back-up cutters may be disposed, for example, in region 1140 of blade 1114*e*. Although only one region 1140 is labeled in FIG. 11 on blade 1114*e*, one or more of the other blades 1114*a*-1114*d* may also each include a secondary row of back-up cutters. The back-up cutters often, collectively, form a cutting profile for the drill bit 1100 that is different from the hybrid or combination primary cutting profile 1120. In some embodiments, the cutting profile formed by the back-up cutters may not coincide with or intersect any portion of one or more of the multiple cutting profiles of the primary cutting profile 1120. In some embodiments, the cutting profile formed by the back-up cutters may coincide with or intersect a portion or portions of one or more of the multiple cutting profiles of the primary cutting profile 1120. Blades 1114*a*, 1114*c*, 1114*d* are blades to center and thus have cutters 1116 disposed in the cone region 1132 of the drill bit 1100, in addition to the nose region 1134, the shoulder region 1136, and/or the gauge region 1138. The cutters 1116 of blades 1114*b*, 1114*e* are disposed in the nose region 1134, the shoulder region 1136, and/or the gauge region 1138. Although five blades 1114*a*-1114*e* are shown and three are blades to center, the drill bit 1100 may include less than five or more than five blades 1114 and may include less than three or more than three blades to center.

The primary cutting profile 1120 may include a first cutting profile 1122 and a second cutting profile 1124 different from the first cutting profile 1122. Each of the first and second cutting profiles 1122, 1124 may define a continuous, smooth cutting profile. The first and second cutting profiles 1122, 1124 coincide with each other in the nose region 1134, the shoulder region 1136, and/or the gauge region 1138, but define different slope angles in the cone region 1132. Specifically, the second cutting profile 1124 defines a deeper or greater slope angle in the cone region 1132. The slope angle of the first cutting profile 1122 in the cone region 1132 may be defined by cutters 1116 of blades 1114*c*, 1114*d* in the cone region 1132. The slope angle of the second cutting profile 1124 in the cone region 1132 may be defined by cutters 1116 of blade 1114*a* in the cone region 1132. The coinciding portions of the first and second cutting profiles 1122, 1124 are defined by cutters 1116 of blades 1114*a*-1114*e* in the nose region 1134, the shoulder region 1136, and/or the gauge region 1138. Although in the example shown in FIG. 11, the cutters 1116 on blades 1114*c*, 1114*d* in the cone region 1132 collectively define the portion of the first cutting profile 1122 in the cone region 1132, the cutters 1116 on blade 1114*c* and the cutters 1116 on blade 1114*d* in the cone region may define different slope angles in some embodiments. In other words, each of the blades to center 1114*a*, 1114*c*, 1114*d* may define different slope angles in the cone region 1132.

In some embodiments, the difference between the slope angles of the different cutting profiles in the cone region 1132, such as the first and second cutting profiles 1122, 1124 in the cone region 1132, may range between 1° and 20°, e.g., between 2° and 18°, between 4° and 16°, between 6° and 14°, between 8° and 12°, between 1° and 10°, between 2° and 9°, between 3° and 8°, between 4° and 7°, between 5° and 6°, between 11° and 20°, between 12° and 19°, between 13° and 18°, between 14° and 17°, or between 15° and 16°. In some embodiments, in terms of upper limits, the difference between the slope angles of the different cutting profiles in the cone region 1132 may be less than 20°, e.g., less than 19°, less than 18°, less than 17°, less than 16°, less than 15°, less than 14°, less than 13°, less than 12°, less than 11°, less than 10°, less than 9°, less than 8°, less than 7°, less than 6°, less than 5°, less than 4°, less than 3°, less than 2°, less than 1°, or less. In some embodiments, in terms of lower limits, the difference between the slope angles of the different cutting profiles in the cone region 1132 may be at least 1°, e.g., at least 2°, at least 3°, at least 4°, at least 5°, at least 6°, at least 7°, at least 8°, at least 9°, at least 10°, at least 11°, at least 12°, at least 13°, at least 14°, at least 15°, at least 16°, at least 17°, at least 18°, at least 19°, at least 20°, or greater.

In some embodiments, the cutters 1116 on the blades to center 1114 in the cone region 1132 may have similar exposures. One or more blades to center 1114 may be offset from the other one or more blades to center. For example, as shown in FIG. 11, blade 1114*a* may be axially recessed relative to blades 1114*c*, 1114*d*, achieving the greater slope angle of the second cutting profile 1124. An axial offset between blade 1114*a* and blades 1114*c*, 1114*d* can be observed in FIG. 11. In some embodiments, each of the blades to center 1114 may be axially offset from each other defining different slope angles in the cone region 1132. In some embodiments, cutters 1116 on one or more blades to center may have different exposures to achieve different slope angles in the cone region 1132, and the blades to center may or may not axially offset from each other.

In some embodiments, the blade to center 1114, such as blade to center 1114*a*, that has cutters 1116 defining the greater slope angle is disposed adjacent to two blades that may not have cutters 1116 disposed in the cone region 1132, such as blades 1114*b*, 1114*e*. In some embodiments, the blade to center 1114 that has cutters 1116 defining the greater slope angle may be disposed adjacent to one or two other blades to center. In some embodiments, the cutters 1116 that define the greater slope angle in the cone region 1132 may be disposed on a single blade to center, such as in the example shown in FIG. 11. In some embodiments, the cutters 1116 that define the greater slope angle in the cone region 1132 may be disposed on more than one blade to center. Thus, a cutter 1116 that in part defines the greater slope angle and another cutter 1116 that also in part defines the greater slope angle may be disposed on a common blade 1114, or may be disposed on different blades 1114. The cutters 1116 that define the greater slope angle in the cone region 1132 may be adjacent to each other when disposed on a common blade 1114, or may be spaced apart by another cutters 1116 that defines the lesser slope angle.

Figure 12A:
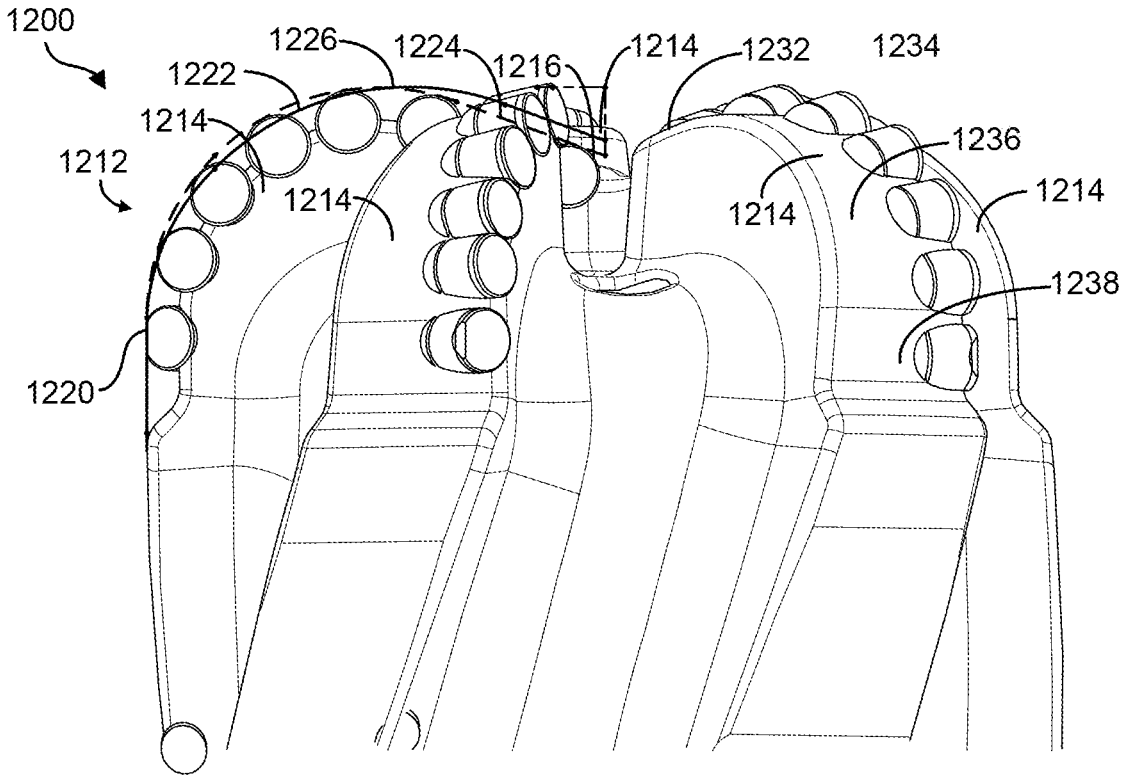
FIGS. 12A and 12B schematically illustrate another exemplary drill bit having cutters defining a hybrid or combination primary cutting profile comprising multiple cutting profiles in accordance with some embodiments of the present invention.
Figure 12B:
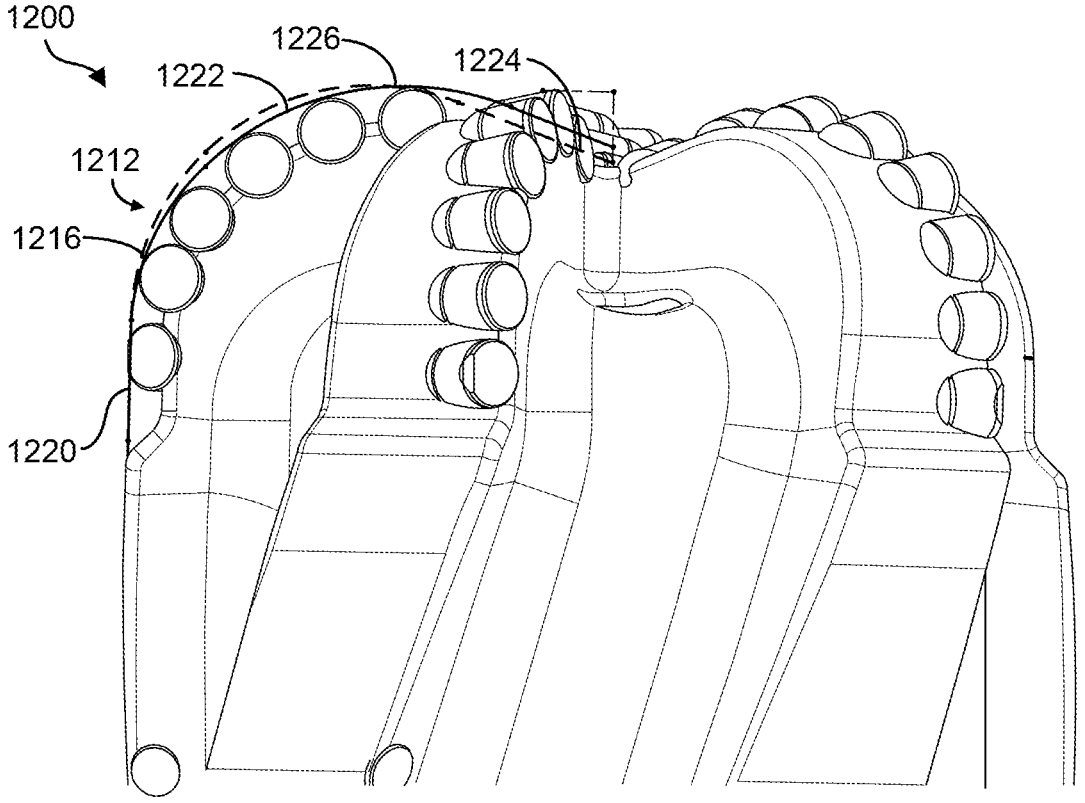

FIGS. 12A and 12B schematically illustrate an exemplary drill bit 1200 having cutters defining a hybrid or combination primary cutting profile 1220 comprising multiple cutting profiles. Similar to the drill bit 1100 shown in FIG. 11, the drill bit 1200 shown in FIGS. 12A and 12B includes five blades 1214 disposed on the bit face 1212, of which three are blades to center, although the drill bit 1200 may include any number of blades in total and any number of blades to center in various embodiments. The primary cutting profile 1220 may include a first cutting profile 1222 and a second cutting profile 1224 different from the first cutting profile 1222. Each of the first and second cutting profiles 1222, 1224 may define a continuous, smooth cutting profile. The first and second cutting profiles 1222, 1224 may intersect each other at point 1226. In some embodiments, the intersecting point 1226 may be disposed in the nose region 1234. In some embodiments, the intersecting point 1226 may be disposed in the cone region 1232. In some embodiments, the intersecting point 1226 may be disposed at the transition from the cone region 1232 to the nose region 1234. The first and second cutting profiles 1222, 1224 may coincide with each other in the gauge region 1238.

The first cutting profile 1222 may define a lesser slope angle than the second cutting profile 1224 in the cone region 1232. The difference between the slope angles of the first and second cutting profiles 1222, 1224 in the cone region 1232 may be similar to the difference between the slope angles of the first and second cutting profiles 1122, 1124 discussed above. The second cutting profile 1224 may protrude from the first cutting profile 1222 in the nose region 1234 and the shoulder region 1236. In some embodiments, the second cutting profile 1224 may be defined by cutters 1216 from at least one or all of the blades to center, such as shown in FIG. 12A. In some embodiments, the first cutting profile 1222 may be defined by cutters 1216 from one or more of the blades that are not blades to center, such as shown FIG. 12B. Thus, the first cutting profile 1222 may include fewer or zero number of cutters in the cone region 1232.

In some embodiments, such as the examples shown in FIGS. 11 and 12, cutters on two or more blades may define a common cutting profile. In some embodiments, cutters on each blade of a drill bit may define a cutting profile different from the cutting profile defined by cutters any other blades. Stated differently, cutters on each blade may define a unique cutting profile. In some embodiments, the different cutting profiles defined by cutters on each blade may be arranged in a cascaded manner. For example, in some embodiments, the cutting profiles, or at least portions thereof, may be further recessed successively from one blade to another, such as defining successively greater slope angles in the cone region from one blade to another. In some embodiments, the different cutting profiles defined by cutters on each blade may be arranged in an alternating manner. For example, in some embodiments, cutters on one blade may define a cutting profile, or at least a portion of a cutting profile, that may either be recessed relatively to, or protrude beyond, two adjacent cutting profiles defined by the cutters on two adjacent blades. The different cutting profiles defined by the different blades may be arranged in any manner in various embodiments, depending on the desired bit performance to be achieved.

In some embodiments, cutters on the same blades may define a common cutting profile. In some embodiments, cutters on a common blade may define different cutting profiles. As already mentioned above, any cutters on any blades may collectively define a cutting profile different from one or more other profiles defined by the remaining cutters based on desired ROP, bit stability, or various other considerations. Each cutting profile may include different number of cutters or a common number of cutters.

While the invention has been described in detail, modifications within the spirit and scope of the invention will be readily apparent to those of skill in the art. It should be understood that aspects of the invention and portions of various embodiments and various features recited above and/or in the appended claims may be combined or interchanged either in whole or in part. In the foregoing descriptions of the various embodiments, those embodiments which refer to another embodiment may be appropriately combined with other embodiments as will be appreciated by one of ordinary skill in the art. Furthermore, those of ordinary skill in the art will appreciate that the foregoing description is by way of example only, and is not intended to limit the invention. All US patents and publications cited herein are incorporated by reference in their entirety.

IV. Embodiments

As used below, any reference to a series of embodiments is to be understood as a reference to each of those embodiments disjunctively (e.g., "Embodiments 1-4" is to be understood as "Embodiments 1, 2, 3, or 4").

Embodiment 1 is a drill bit, comprising: a body having a face and a bit axis, wherein the face comprises a cone region disposed about the bit axis, a nose region disposed radially outward from the cone region, and a shoulder region disposed radially outward from the nose region; a first plurality of cutters defining a first cutting profile; and a second plurality of cutters defining a second cutting profile different from the first cutting profile, wherein: at least a portion of the first cutting profile coincides with or intersects at least a portion of the second cutting profile; and the first cutting profile and the second cutting profile define different slopes in the cone region.

Embodiment 2 is the drill bit of embodiment(s) 1, wherein the second cutting profile defines a greater slope in the cone region than the first cutting profile.

Embodiment 3 is the drill bit of embodiment(s) 1-2, wherein the first cutting profile and the second cutting profile coincide in at least one of the nose region or the shoulder region.

Embodiment 4 is the drill bit of embodiment(s) 1-3, wherein the second cutting profile is recessed relatively to the first cutting profile in at least one of the cone region, the nose region, or the shoulder region.

Embodiment 5 is the drill bit of embodiment(s) 1-4, wherein the second cutting profile protrudes from the first cutting profile in at least one of the nose region or the shoulder region.

Embodiment 6 is the drill bit of embodiment(s) 1-5, wherein the first cutting profile and the second cutting profile define different curvatures in at least one of the nose region or the shoulder region.

Embodiment 7 is the drill bit of embodiment(s) 1-6, wherein the first cutting profile intersects the second cutting profile at a single location.

Embodiment 8 is the drill bit of embodiment(s) 1-6, wherein the first cutting profile intersects the second cutting profile at two discreet locations.

Embodiment 9 is the drill bit of embodiment(s) 1-8, wherein the first cutting profile and the second cutting profile coincide in at least one of the nose region, the shoulder region, or a gauge region.

Embodiment 10 is the drill bit of embodiment(s) 1-9, wherein a majority of the first plurality of cutters are primary cutters.

Embodiment 11 is the drill bit of embodiment(s) 1-10, wherein a majority of the second plurality of cutters are primary cutters.

Embodiment 12 is the drill bit of embodiment(s) 1-11, wherein the first plurality of cutters and the second plurality of cutters have equal number of cutters.

Embodiment 13 is the drill bit of embodiment(s) 1-12, further comprising a third plurality of cutters defining a third cutting profile that is different from at least one of the first cutting profile or the second cutting profile, wherein the first plurality of cutters, the second plurality of cutters, and the third plurality of cutters have equal number of cutters.

Embodiment 14 is the drill bit of embodiment(s) 1-13, further comprising a first blade disposed on the face, wherein the first plurality of cutters is disposed on the first blade.

Embodiment 15 is the drill bit of embodiment(s) 14, wherein the second plurality of cutters is disposed on the first blade.

Embodiment 16 is the drill bit of embodiment(s) 14-15, wherein the drill bit further comprises a second blade, and wherein the second plurality of cutters is disposed on the second blade.

Embodiment 17 is the drill bit of embodiment(s) 16, wherein at least one of the first plurality of cutters is disposed at a common radial distance as at least one of the second plurality of cutters.

Embodiment 18 is the drill bit of embodiment(s) 1-17, further comprising a plurality of blades, wherein the first plurality of cutters is disposed on a first blade of the plurality of blades, wherein the second plurality of cutters is disposed on a second blade of the plurality of blades, and wherein cutters on each blade of the plurality of blades define a cutting profile different from any cutting profile defined by cutters on any other blade of the plurality of blades.

Embodiment 19 is the drill bit of embodiment(s) 1-18, wherein a majority of the first plurality of cutters and a majority of the second plurality of cutters are arranged in an alternating manner.

Embodiment 20 is the drill bit of embodiment(s) 1-19, wherein a majority of the first plurality of cutters and a majority of the second plurality of cutters are disposed at different radial distances from the bit axis.

Embodiment 21 is the drill bit of embodiment(s) 1-20, wherein the first cutting profile defines a smooth cutting profile.

Embodiment 22 is the drill bit of embodiment(s) 1-21, wherein the first plurality of cutters have back rake angles within a first range, and wherein the second plurality of cutters have back rake angles within a second range different from the first range.

Embodiment 23 is the drill bit of embodiment(s) 1-22, wherein the first plurality of cutters have side rake angles within a first range, and wherein the second plurality of cutters have side rake angles within a second range different from the first range.

Embodiment 24 is a drill bit: a bit body having a bit face and a bit axis; a first plurality of cutters defining a first cutting profile; and a second plurality of cutters defining a second cutting profile different from the first cutting profile, wherein: the first cutting profile and the second cutting profile define different slopes in a cone region of the bit face; and the second plurality of cutters are not back-up cutters to the first plurality of cutters.

Embodiment 25 is the drill bit of embodiment(s) 24, wherein a majority of the first plurality of cutters and a majority of the second plurality of cutters are disposed at different radial distances from the bit axis.

Embodiment 26 is the drill bit of embodiment(s) 24-25, wherein the first plurality of cutters and the second plurality of cutters are not gauge cutters.

Embodiment 27 is a method of drilling a subterranean formation, comprising: engaging a subterranean formation with at least one cutter of a drill bit, wherein the drill bit comprises: a bit body having a bit face and a bit axis; a first plurality of cutters defining a first cutting profile; and a second plurality of cutters defining a second cutting profile different from the first cutting profile, wherein: at least a portion of the first cutting profile coincides with or intersects at least a portion of the second cutting profile; and the first cutting profile and the second cutting profile define different slopes in a cone region of the bit face.

Embodiment 28 is a method of configuring a drill bit, comprising: configuring a bit body having a bit face and a bit axis; configuring a first plurality of cutters defining a first cutting profile; and configuring a second plurality of cutters defining a second cutting profile different from the first cutting profile such that: at least a portion of the first cutting profile coincides with or intersects at least a portion of the second cutting profile; and the second plurality of cutters are not back-up cutters to the first plurality of cutters.

Embodiment 29 is a method of making a drill bit, comprising: providing a bit body having a bit face and a bit axis; providing a first plurality of cutters defining a first cutting profile; and proving a second plurality of cutters defining a second cutting profile different from the first cutting profile, wherein: the first cutting profile and the second cutting profile define different slopes in a cone region of the bit face; and the second plurality of cutters are not back-up cutters to the first plurality of cutters.

What is claimed is:

1. A drill bit, comprising:

a body having a face and a bit axis, wherein the face comprises a cone region disposed about the bit axis, a nose region disposed radially outward from the cone region, and a shoulder region disposed radially outward from the nose region;

at least one blade disposed on the face;

a first plurality of cutters defining a first cutting profile; and a second plurality of cutters defining a second cutting profile different from the first cutting profile, wherein:

each of the first plurality of cutters and the second plurality of cutters comprise fixed polycrystalline diamond (PDC) cutters;

each of the first plurality of cutters and the second plurality of cutters are disposed on a leading edge of a respective one of the at least one blade;

at least a portion of the first cutting profile coincides with or intersects at least a portion of the second cutting profile; and the first cutting profile and the second cutting profile define different slopes in the cone region.

2. The drill bit of claim 1, wherein the second cutting profile defines a greater slope in the cone region than the first cutting profile.

3. The drill bit of claim 1, wherein the first cutting profile and the second cutting profile coincide in at least one of the nose region or the shoulder region.

4. The drill bit of claim 1, wherein the second cutting profile is recessed relatively to the first cutting profile in at least one of the cone region, the nose region, or the shoulder region.

5. The drill bit of claim 1, wherein the second cutting profile protrudes from the first cutting profile in at least one of the nose region or the shoulder region.

6. The drill bit of claim 1, wherein the first cutting profile and the second cutting profile define different curvatures in at least one of the nose region or the shoulder region.

7. The drill bit of claim 1, wherein the first cutting profile intersects the second cutting profile at a single location.

8. The drill bit of claim 1, wherein the first cutting profile intersects the second cutting profile at two discreet locations.

9. The drill bit of claim 1, wherein the first cutting profile and the second cutting profile coincide in at least one of the nose region, the shoulder region, or a gauge region.

10. The drill bit of claim 1, wherein a majority of the first plurality of cutters are primary cutters.

11. The drill bit of claim 1, wherein a majority of the second plurality of cutters are primary cutters.

12. The drill bit of claim 1, wherein the first plurality of cutters and the second plurality of cutters have equal number of cutters.

13. The drill bit of claim 1, further comprising a third plurality of cutters defining a third cutting profile that is different from at least one of the first cutting profile or the second cutting profile, wherein the first plurality of cutters, the second plurality of cutters, and the third plurality of cutters have equal number of cutters.

14. The drill bit of claim 1, wherein the at least one blade comprises a first blade, wherein the first plurality of cutters is disposed on the first blade.

15. The drill bit of claim 14, wherein the second plurality of cutters is disposed on the first blade.

16. The drill bit of claim 14, wherein at least one blade comprises a second blade, and wherein the second plurality of cutters is disposed on the second blade.

17. The drill bit of claim 16, wherein at least one of the first plurality of cutters is disposed at a common radial distance as at least one of the second plurality of cutters.

18. The drill bit of claim 1, wherein the at least one blade comprises a plurality of blades, wherein the first plurality of cutters is disposed on a first blade of the plurality of blades, wherein the second plurality of cutters is disposed on a second blade of the plurality of blades, and wherein respective cutters on each respective blade of the plurality of blades define a cutting profile different from any cutting profile defined by the respective cutters on any other respective blade of the plurality of blades.

19. The drill bit of claim 1, wherein a majority of the first plurality of cutters and a majority of the second plurality of cutters are arranged in an alternating manner as a radial distance from the bit axis increases.

20. The drill bit of claim 1, wherein a majority of the first plurality of cutters and a majority of the second plurality of cutters are disposed at different radial distances from the bit axis.

21. The drill bit of claim 1, wherein the first cutting profile defines a smooth cutting profile.

22. The drill bit of claim 1, wherein the first plurality of cutters have back rake angles within a first range, and wherein the second plurality of cutters have back rake angles within a second range different from the first range.

23. The drill bit of claim 1, wherein the first plurality of cutters have side rake angles within a first range, and wherein the second plurality of cutters have side rake angles within a second range different from the first range.

24. A drill bit:

a bit body having a bit face and a bit axis;

at least one blade disposed on the bit face;

a first plurality of cutters defining a first cutting profile; and a second plurality of cutters defining a second cutting profile different from the first cutting profile, wherein:

each of the first plurality of cutters and the second plurality of cutters comprise fixed polycrystalline diamond (PDC) cutters;

each of the first plurality of cutters and the second plurality of cutters are disposed on a leading edge of a respective one of the at least one blade;

the first cutting profile and the second cutting profile define different slopes in a cone region of the bit face; and the second plurality of cutters are not back-up cutters to the first plurality of cutters.

25. The drill bit of claim 24, wherein a majority of the first plurality of cutters and a majority of the second plurality of cutters are disposed at different radial distances from the bit axis.

26. The drill bit of claim 24, wherein the first plurality of cutters and the second plurality of cutters are not gauge cutters.

27. A method of drilling a subterranean formation, comprising:

engaging a subterranean formation with at least one cutter of a drill bit, wherein the drill bit comprises:

a bit body having a bit face and a bit axis;

at least one blade disposed on the bit face;

a first plurality of cutters defining a first cutting profile; and a second plurality of cutters defining a second cutting profile different from the first cutting profile, wherein:

each of the first plurality of cutters and the second plurality of cutters comprise fixed polycrystalline diamond (PDC) cutters;

each of the first plurality of cutters and the second plurality of cutters are disposed on a leading edge of a respective one of the at least one blade;

at least a portion of the first cutting profile coincides with or intersects at least a portion of the second cutting profile; and the first cutting profile and the second cutting profile define different slopes in a cone region of the bit face.

28. A method of configuring a drill bit, comprising:

configuring a bit body having a bit face and a bit axis;

configuring at least one blade disposed on the bit face;

configuring a first plurality of cutters defining a first cutting profile; and configuring a second plurality of cutters defining a second cutting profile different from the first cutting profile such that:

each of the first plurality of cutters and the second plurality of cutters comprise fixed polycrystalline diamond (PDC) cutters;

each of the first plurality of cutters and the second plurality of cutters are disposed on a leading edge of a respective one of the at least one blade;

the first cutting profile and the second cutting profile define different slopes in a cone region of the bit face;

at least a portion of the first cutting profile coincides with or intersects at least a portion of the second cutting profile; and the second plurality of cutters are not back-up cutters to the first plurality of cutters.

29. A method of making a drill bit, comprising:

providing a bit body having a bit face and a bit axis;

providing at least one blade on the bit face;

providing a first plurality of cutters defining a first cutting profile; and providing a second plurality of cutters defining a second cutting profile different from the first cutting profile, wherein:

each of the first plurality of cutters and the second plurality of cutters comprise fixed polycrystalline diamond (PDC) cutters;

each of the first plurality of cutters and the second plurality of cutters are disposed on a leading edge of a respective one of the at least one blade;

the first cutting profile and the second cutting profile define different slopes in a cone region of the bit face; and the second plurality of cutters are not back-up cutters to the first plurality of cutters.

* * * * *